US006987944B2

(12) United States Patent
Shakuto et al.

(10) Patent No.: US 6,987,944 B2
(45) Date of Patent: Jan. 17, 2006

(54) CLEANING DEVICE AND IMAGE FORMING APPARATUS USING THE CLEANING DEVICE

(75) Inventors: Masahiko Shakuto, Kawasaki (JP); Yasushi Nakazato, Tokyo (JP); Osamu Naruse, Yokohama (JP); Naomi Sugimoto, Kawasaki (JP); Takahiko Tokumasu, Atsugi (JP); Kenji Sugiura, Yokohama (JP); Tohru Nakano, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 78 days.

(21) Appl. No.: 10/107,249

(22) Filed: Mar. 28, 2002

(65) Prior Publication Data

US 2003/0039494 A1 Feb. 27, 2003

(30) Foreign Application Priority Data

Mar. 28, 2001 (JP) ..... 2001-091696
May 18, 2001 (JP) ..... 2001-150087

(51) Int. Cl.
*G03G 21/00* (2006.01)

(52) U.S. Cl. ..... 399/353; 399/357

(58) Field of Classification Search ..... 399/100, 399/174–176, 349, 353, 354, 357
See application file for complete search history.

(56) References Cited

U.S. PATENT DOCUMENTS 3,848,994 A * 11/1974 Fraser ..... 399/354
4,252,433 A * 2/1981 Sullivan ..... 399/357
5,130,755 A * 7/1992 Ikegawa et al. ..... 399/357
5,148,227 A * 9/1992 Senba et al. ..... 399/349
5,233,398 A * 8/1993 Nimura et al. ..... 399/354
5,260,754 A 11/1993 Yano et al.

(Continued)

FOREIGN PATENT DOCUMENTS

| | | |
|---|---|---|
| JP | 1-142972 | 9/1989 |
| JP | 4-141678 | 5/1992 |
| JP | 4-112274 | 9/1992 |
| JP | 4-267282 | 9/1992 |
| JP | 4-330482 | 11/1992 |
| JP | 4-353877 | 12/1992 |
| JP | 5-265360 | 10/1993 |
| JP | 6-161330 | 6/1994 |
| JP | 7-36342 | 2/1995 |
| JP | 7-155222 | 6/1995 |

(Continued)

*Primary Examiner*—Robert Beatty
(74) *Attorney, Agent, or Firm*—Oblon, Spivak, McClelland, Maier & Neustadt, P.C.

(57) ABSTRACT

An image forming apparatus includes an image bearer, a charging device that charges a surface of the image bearer, a latent image forming device that forms a latent image on the image bearer, a developing device that develops the latent image on the image bearer with a spherical toner into a toner image, a transfer device that transfers the toner image to a transfer material, and a cleaning device that removes the spherical toner remaining on the image bearer after the toner image is transferred to the transfer material. The cleaning device including a cleaning roller that removes the spherical toner on the image bearer while rotating and contacting the image bearer and which has a greater coefficient of static friction than the surface of the image bearer. An electric field is formed between the cleaning member and the image bearer by applying a voltage to the cleaning member so that the spherical toner adhered onto the image bearer is electrostatically attracted to the cleaning member. The cleaning member may also include a brush roller having bristles planted in a specific configuration.

55 Claims, 16 Drawing Sheets

U.S. PATENT DOCUMENTS 5,376,997 A * 12/1994 Yamato et al. ..... 399/356
5,386,274 A 1/1995 Sanpe et al.
5,526,100 A 6/1996 Misago et al.
5,559,593 A * 9/1996 Yoshinaga et al. ..... 399/343
5,592,267 A 1/1997 Misago et al.
5,606,408 A 2/1997 Yano et al.
5,638,159 A 6/1997 Kai et al.
5,740,494 A 4/1998 Shoji et al.
5,765,087 A 6/1998 Yano et al.
5,809,388 A 9/1998 Inada et al.
5,835,821 A * 11/1998 Suzuki et al. ..... 399/100
5,864,737 A 1/1999 Obu et al.
5,923,930 A 7/1999 Tsukamoto et al.
5,937,247 A 8/1999 Takeuchi et al.
5,987,281 A 11/1999 Kurotori et al.
5,999,779 A 12/1999 Takeuchi
6,038,421 A 3/2000 Yoshino et al.
6,061,540 A 5/2000 Takeda
6,108,508 A 8/2000 Takeuchi et al.
6,115,576 A 9/2000 Nakano et al.
6,131,001 A 10/2000 Tsukamoto et al.
6,134,394 A 10/2000 Tsukamoto et al.
6,154,624 A 11/2000 Sasaki et al.
6,236,825 B1 5/2001 Takeuchi
6,358,658 B1 * 3/2002 Tazawa et al. ..... 430/110.1
6,381,432 B1 * 4/2002 Hattori ..... 399/176
6,405,008 B1 6/2002 Obu et al.
6,442,362 B2 * 8/2002 Hirabayashi et al. ..... 399/149
6,505,014 B2 1/2003 Aoki et al.
6,560,418 B2 * 5/2003 Campbell et al. ..... 399/49

FOREIGN PATENT DOCUMENTS

JP 8-202125 8/1996
JP 08314347 A * 11/1996
JP 09034261 A * 2/1997
JP 9-114201 5/1997
JP 9-218527 8/1997
JP 10-10942 1/1998
JP 10073983 A * 3/1998
JP 10-161502 6/1998
JP 7-210053 8/1998
JP 10-333514 12/1998
JP 11-15189 1/1999
JP 11-65167 3/1999
JP 11-95478 4/1999
JP 2000-75745 3/2000
JP 2000-293013 10/2000
JP 2001-34131 2/2001
JP 2001-56629 2/2001
JP 2001056628 A * 2/2001
JP 2001-66854 3/2001
JP 2001-188405 7/2001
JP 2002-214822 7/2002

* cited by examiner

CLEANING DEVICE AND IMAGE FORMING APPARATUS USING THE CLEANING DEVICE

BACKGROUND OF THE INVENTION

1. Field of the Invention

The present invention relates to an image forming apparatus such as a copying machine, a printer, a facsimile, etc. or a multi-functional image forming apparatus, and more particularly to a cleaning device that removes residual toner on an image bearer of the image forming apparatus.

2. Discussion of the Background

Recently, demands for enhancing a quality of an image formed by an electrophotographic image forming apparatus has been increased. In order to enhance an image quality, it has been found that reducing a particle diameter of toner, uniforming a toner particle diameter, and enhancing a degree of a spherical shape of the toner are important. In an image forming apparatus for forming a full-color image, it has been found that the glossiness of an image affects an image quality.

Toner prepared by a polymerization method is known as the toner that satisfies the above-described demands. With the use of the toner prepared by the polymerization method, the image quality can be effectively enhanced.

However, when the toner prepared by the polymerization method is used in a conventional image forming apparatus, and transfer residual toner remaining on an image bearer after transferring of the toner image is removed by a cleaning member, a removal efficiency of the toner, that is, a cleaning efficiency may be deteriorated. For example, a cleaning blade whose edge is in press-contact with the surface of the image bearer is used as the cleaning member. When the transfer residual toner is removed from the image bearer by the cleaning blade, a space between the surface of the image bearer and the edge of the cleaning blade is in a most densely filled state with the transfer residual toner. A first layer of the toner having a strong adhesion force to the image bearer and a second layer of the toner slip against each other, and the first layer of toner adhering to the image bear surface sometimes passes the edge of the cleaning blade. As a result, the first layer of toner remains on the image bearer, thereby causing a cleaning defect.

In order to efficiently remove residual toner from an image bearer, Japanese Laid-open Patent Publication No. 5-265360 describes a cleaning method and device in which residual toner on a surface of an image bearer is removed by a cleaning blade press-contacted against the surface of the image bearer. The cleaning blade includes a conductive member. The residual toner on the surface of the image bearer is removed by applying alternating current (AC) bias voltage, and direct current (DC) bias voltage which has the same polarity as an electrostatic charge of toner at the time of developing, to the cleaning blade.

In a case of using a cleaning blade, when toner containing polyester-based toner binder having a small particle diameter, spherical shape, and melt viscosity lower than that of conventional toner is used in an image forming apparatus, the wax in the toner bleeds out and adheres to an image bearer due to the pressing force of the cleaning blade against the toner on the image bearer. As a result, a so-called wax filming, in which a film of wax of toner adheres to a surface of an image bearer, typically occurs.

FIG. 29 is a graph showing a relationship between the coefficient of friction of an image bearer and an operation time of an image forming apparatus when a wax filming occurs and does not occur. As seen from FIG. 29, when the wax filming occurs, the coefficient of friction of the image bearer decreases. When the coefficient of friction of the image bearer decreases due to the wax filming, the adhesion force between the image bearer and the toner is reduced by the wax filming. As a result, the toner on the image bearer is easily transferred to a transfer material such as a transfer sheet before a nip part formed between the image bearer and the transfer material by electric discharge, thereby causing an image deterioration such as toner scattering.

Further, a spherical dry toner, which contains at least modified polyester having a urea bond as a toner binder, and contains a wax finely dispersed in the spherical dry toner, has a property similar to a property of the toner prepared by a polymerization method. When the spherical dry toner is used, a high-quality image may be formed. In addition, when a toner image transferred to a transfer material is fixed by a fixing device, the toner image may be fixed at a relatively low temperature. Further, a hot offset phenomenon in which the toner attaches to a fixing member may be typically avoided. Furthermore, when the spherical dry toner is used in an image forming apparatus for forming a full-color image, color reproducibility, transparency, and glossiness stability of the image may be enhanced. However, even with the use of the spherical dry toner, because the particle diameter of the spherical dry toner is small, a problem similar to the problem with the use of the toner prepared by a polymerization method typically occurs.

In recent years, in the image forming apparatus, a contact type charging member has been often used as a charging member for charging the image bearer. The charging member abuts on the image bearer surface, causes electric discharge between the charging member and the image bearer, and charges the image bearer. When the contact type charging member is used, an amount of ozone generated during the electric discharge can be advantageously reduced.

However, when the contact type charging member is used, and the cleaning blade removes the toner prepared by a polymerization method from an image bearer, the cleaning efficiency is deteriorated as described above. When the amount of the transfer residual toner passed through the charging member increases, the toner adheres to the charging member, and the charging member is stained by the toner. Therefore, a charging function of the charging member is deteriorated, and the useful lifetime of the charging member is reduced.

Particularly, when a press contact force of the edge of the cleaning blade onto the image bearer is locally decreased, the amount of the transfer residual toner passed through the corresponding portion increases, and the charging member is partially and extremely stained by the passed toner. When the charging member is partially stained in this manner, the charging efficiency is locally deteriorated with respect to the surface of the image bearer, and the quality of the toner image is partially deteriorated. Therefore, it is necessary to replace the charging member partially and remarkably stained by the toner with a new charging member. In the conventional image forming apparatus, the partial stain of the charging member occurs in a relatively early stage, which thereby causes the useful lifetime of the charging member to decrease.

SUMMARY OF THE INVENTION

According to one aspect of the present invention, a cleaning device includes a cleaning member configured to remove a spherical toner on an image bearer while rotating and contacting the image bearer which is rotating. An electric field is formed between the cleaning member and the image bearer by applying a voltage to the cleaning member so that the spherical toner adhered onto the image bearer is electrostatically attracted to the cleaning member.

According to another aspect of the present invention, an image forming apparatus includes an image bearer configured to bear an electrostatic latent image while rotating, a charging device configured to charge a surface of the image bearer, a latent image forming device configured to form the electrostatic latent image on the image bearer, a developing device configured to develop the electrostatic latent image on the image bearer with a spherical toner into a toner image, a transfer device configured to transfer the toner image to a transfer material, and a cleaning device configured to remove the spherical toner remaining on the image bearer after the toner image is transferred to the transfer material by the transfer device. The cleaning device includes a cleaning member configured to remove the spherical toner on the image bearer while rotating and contacting the image bearer. An electric field is formed between the cleaning member and the image bearer by applying a voltage to the cleaning member so that the spherical toner adhered onto the image bearer is electrostatically attracted to the cleaning member.

Objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
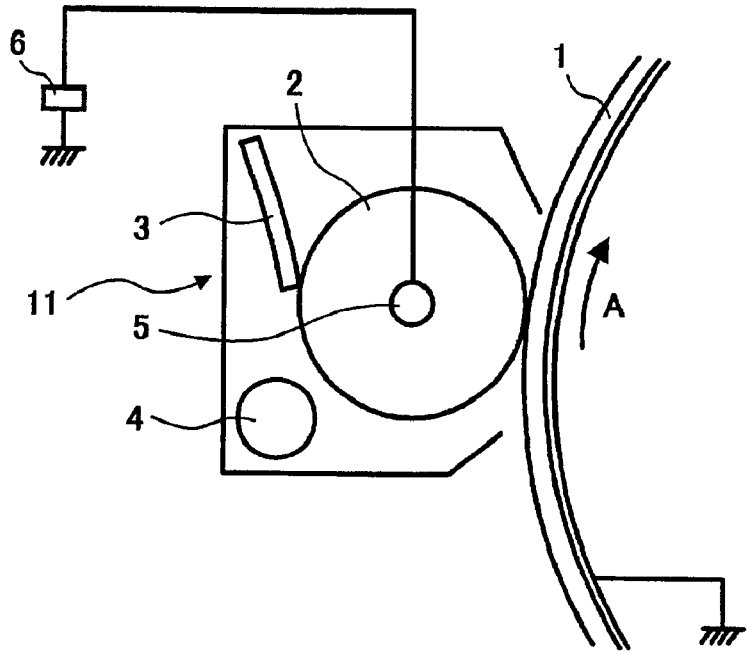
FIG. 1 is a schematic view of a construction around a cleaning device of an image forming apparatus according to an embodiment of the present invention.

Preferred embodiments of the present invention are described in detail referring to the drawings, wherein like reference numerals designate identical or corresponding parts throughout the several views.

FIG. 1 is a schematic view of a construction around a cleaning device of an image forming apparatus according to an embodiment of the present invention.

Referring to FIG. 1, a reference numeral 1 denotes an image bearer which rotates in a direction of an arrow A. A reference numeral 11 denotes a cleaning device. The cleaning device 11 includes a cleaning roller 2 serving as a cleaning member, a scraper blade member 3 serving as a toner scraping member that abuts the cleaning roller 2, and a toner conveying coil 4. The cleaning roller 2 includes, for example, a conductive elastic layer (e.g., a layer formed from conductive rubber) having a rubber hardness, which is prescribed in JIS-A (Japanese Industrial Standards A) of 15° to 80° and volume resistance of $10^5$ Ω•cm to $10^{15}$ Ω•cm around a metal shaft portion. The cleaning roller 2 may further include a tube or coat layer formed from a conductive fluorine resin having a volume resistance of $10^6$ Ω•cm to $10^{16}$ Ω•cm around the conductive rubber layer. Alternatively, the cleaning roller 2 may have any construction as long as at least a portion of the cleaning roller 2 which contacts the image bearer 1 is made of an elastic material. For example, the elastic material is a solid rubber or a soft foaming material.

The cleaning roller 2 is pressed against the surface of the image bearer 1 with a force of 300 gf to 700 gf by a pressing member (not shown), and disposed in a position where the cleaning roller 2 intrudes into the surface of the image bearer 1 by an intrusion amount of 0.2 mm to 1.0 mm. A surface roughness (Rz) of the cleaning roller 2 is 5 μm or less.

According to the embodiment of the present invention, the cleaning roller 2 including the conductive elastic layer having a rubber hardness of 70° and volume resistance of $10^9$ Ω•cm around a core metal 5 is employed as a cleaning member. The cleaning roller 2 is pressed against the surface of the image bearer 1 with a force of 500 gf by a spring, and is disposed in a position where the cleaning roller 2 intrudes into the surface of the image bearer 1 by an intrusion amount of 0.3 mm.

Moreover, the cleaning roller 2 is rotated at the substantially same speed as a rotation speed of the image bearer 1 by a cleaning member driving device (not shown). With the rotation of the cleaning roller 2, the residual toner on the image bearer 1 is adhered onto the cleaning roller 2. The toner adhered onto the cleaning roller 2 reaches a contact portion of the cleaning roller 2 and the scraper blade member 3 formed from sheet-shaped polyurethane and held by a blade holder, and is scraped from the surface of the cleaning roller 2 by the scraper blade member 3. Subsequently, the toner drops onto the rotating toner conveying coil 4, and is discharged from the cleaning device 11 by the toner conveying coil 4. With provision of the scraper blade member 3, the toner on the cleaning roller 2 can be prevented from re-adhering to the image bearer 1.

Figure 2:
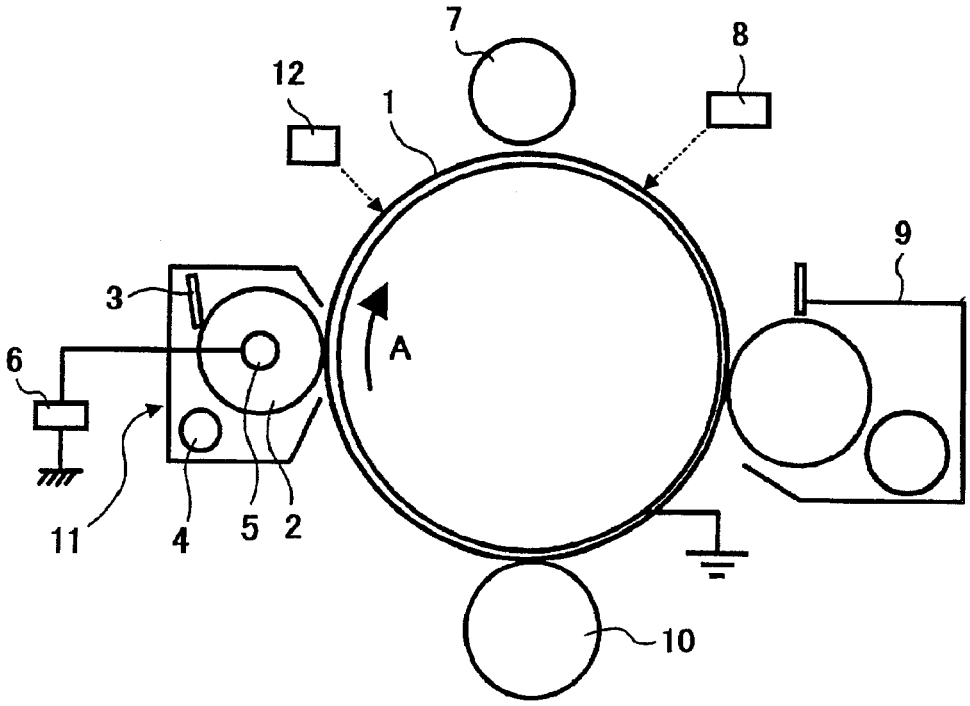
FIG. 2 is a schematic view of a construction of a main part of an image forming apparatus including the cleaning device of FIG. 1.

FIG. 2 is a schematic view of a construction of a main part of an image forming apparatus including the cleaning device 11 of FIG. 1.

The image forming apparatus includes a charging device 7, an exposing device 8, a developing device 9, a transfer device 10, the cleaning device 11, and a discharging device 12 arranged around the image bearer 1 which rotates in the direction of the arrow A. Although not shown, the image forming apparatus further includes a fixing device that fixes a toner image transferred from the image bearer 1 onto a transfer material.

In this embodiment, the image bearer 1 is a negatively charged organic photo semiconductor (OPC) photoreceptor. The image bearer 1 may be other than the OPC photoreceptor, for example, an inorganic photoreceptor, an amorphous silicon photoreceptor, or the like. In this embodiment, the rotation speed of the image bearer 1 is set to 200 mm/sec.

The charging device 7 is provided in a non-contacting relation to the image bearer 1. When a predetermined voltage is applied to the image bearer 1 from the charging device 7, the image bearer 1 is charged with a predetermined polarity and potential. In this embodiment, the charging device 7 uniformly charges the image bearer 1 with a negative polarity. The details of the charging device 7 will be described later.

The exposing device 8 uses a laser diode (LD) as a light emitting element, and irradiates the image bearer 1 with light based on image data, thereby forming an electrostatic latent image on the image bearer 1. Although the laser diode is used in this embodiment, other light emitting elements such as a light-emitting diode (LED) may be used.

The developing device 9 includes a rotatable developer carrier having a magnet roller fixed inside the carrier to hold developer, and an agitating/conveying screw for agitating and conveying the developer. In this embodiment, a two-component magnetic brush developing is performed in which a two-component developer containing toner and magnetic carrier is used as the developer. Instead of the two-component developer, one-component developer containing only toner may be used. A voltage is applied to the developer carrier from a developing bias power supply, and the electrostatic latent image on the image bearer 1 is developed with charged toner in a developing region. The details of toner for use will be described later.

The transfer device 10 is brought into contact with the surface of the image bearer 1 with a predetermined pressing force during transferring. When the voltage is applied to the transfer device 10 from a power supply (not shown), the toner image on the surface of the image bearer 1 is transferred to a transfer material in a transfer nip portion between the image bearer 1 and the transfer device 10. In this embodiment, a transfer roller is used to perform the transferring. Other transfer devices such as Corotron, and transfer belt may be used.

The discharging device 12 eliminates a residual charge from the image bearer 1, and uses LED.

In the image forming apparatus illustrated in FIG. 2, after an image forming process, the residual toner on the image bearer 1 reaches a position where the cleaning roller 2 of the cleaning device 11 opposes the image bearer 1.

Table 1 shows a measurement result of a charging amount (hereinafter referred to as Q/M) per toner unit weight after the developing and transferring, when a solid image is formed on the image bearer 1. A measurement method includes the steps of: forming a solid image pattern with an image area fixed therein on the image bearer 1; forcibly turning off a main switch of the image forming apparatus after end of each of developing, transferring, cleaning, and other processes; attracting the toner image formed on the image bearer 1 with an air pump by a suction jig; measuring a coulomb amount of toner with a coulomb meter (electrometer 611 manufactured by Kesley); and calculating a toner charge amount (μC/g) per unit weight from the weight and coulomb amount of toner attracted by the suction jig.

It has been seen from Table 1 that the Q/M of a transfer residual toner also changes with a change of a transfer voltage. For the transfer device 10, the process is controlled in order to absorb changes of a transfer efficiency with respect to various fluctuation factors such as a type of the transfer material, use environmental conditions and mode of the image forming apparatus, and fluctuation with a lapse of time. The transfer voltage is controlled so that a best image is obtained in accordance with situations. Therefore, for example, when there is a change in the transfer voltage (2)

of Table 1, the charging amount of the transfer residual toner on the image bearer 1 fluctuates as shown in the transfer residual toner Q/M (3) of Table 1.

TABLE 1

| (1) Toner Q/M [μC/g] after developing | (2) Transfer voltage [V] | (3) Transfer residual toner Q/M [μC/g] |
|---|---|---|
| −26.8 | 1600 | −15.6 |
| −26.8 | 1850 | −8.2 |
| −26.8 | 2100 | −6.9 |

When a direct current voltage is applied to the core metal 5 of the cleaning roller 2 from a power supply 6, the transfer residual toner, having a negative polarity as shown in Table 1, adheres to the cleaning roller 2 by a positive electric field formed between the cleaning roller 2 and the image bearer 1. Thereby, the transfer residual toner is removed from the image bearer 1.

In this embodiment, while a rotation speed of the image bearer 1 is set to be the same as that of the cleaning roller 2, the voltage of 700V is applied to the core metal 5 of the cleaning roller 2. In this condition, the cleaning residual toner on the image bearer 1 is transferred to a tape, and a reflectance (ID) of the toner is measured. The measured reflectance is obtained as 0.02, so that the cleaning is adequately performed. Additionally, the condition is not limited to this. For example, when the voltage of 400V to 800V is applied to the core metal 5 of the cleaning roller 2, adequate cleaning properties are similarly obtained. The proper bias voltage fluctuates with environmental conditions, resistivity and thickness of the cleaning roller 2 for use, etc.

A method of measuring "residual toner reflectance (ID)" includes the steps of: transferring cleaning residual toner on the image bearer 1 passed through the cleaning roller 2 to a transparent tape (Printack manufactured by Nitto Denko Corp.); measuring an image density of the toner with an image densitometer (X-Rite 938); and measuring the reflectance of the toner as the residual toner ID. With absence of the toner, the image density of the tape is measured and used as a reference ID. The cleaning residual toner ID is obtained by subtracting the reference ID from the residual toner ID.

As the toner used in this embodiment, a spherical dry toner is used which contains at least modified polyester having a urea bond as a toner binder, and contains a wax finely dispersed in the spherical dry toner. The toner image produced by this spherical dry toner has a gloss of 5% to 30% even when the temperature of the fixing member varies within 50 degrees (e.g., from 100 degrees to 150 degrees).

Examples of the polyester having the urea bond include a reaction product of polyester prepolymer having an isocyanate group with amines. Examples of polyester prepolymer having the isocyanate group include a reaction product obtained by allowing polyester formed of polycondensate of polyol and polycarboxylic acid and having an active hydrogen group to further react with polyisocyanate. Examples of the active hydrogen group that polyester has include a hydroxyl group (alcoholic hydroxyl group and phenolic hydroxyl group), amino group, carboxyl group, mercapto group, and the like. Among these, the alcoholic hydroxyl group is preferable.

Roundness of the toner was defined as follows: roundness equals the circumferential length of a circle having the same area as a projection area of a particle divided by the contour length of a particle projected image Spherical toners superior in cleaning properties in the cleaning device are compared with one another in view of the roundness.

Table 2 shows the cleaning residual toner ID of toner A (roundness of 0.94), toner B (roundness of 0.96), and toner C (roundness of 0.98) measured under the same condition. It can be seen that the toner B and toner C are superior to the toner A in an electrostatic cleaning ability.

TABLE 2

Residual Toner ID by Roundness

| | Residual toner ID | | |
|---|---|---|---|
| Voltage (V) applied to cleaning roller | Toner A (Roundness 0.94) | Toner B (Roundness 0.96) | Toner C (Roundness 0.98) |
| 300 | 0.132 | 0.022 | 0.005 |
| 500 | 0.074 | 0.007 | 0.004 |
| 600 | | 0.004 | |
| 700 | 0.054 | 0.003 | 0.001 |
| 800 | | 0.004 | |
| 900 | 0.116 | 0.006 | 0.001 |

Moreover, an image forming process of using the toner C to develop the latent image formed on the image bearer 1 with toner, transferring a toner image to a transfer material, and cleaning the image bearer 1 by the cleaning device 11 was performed over a copy operation of 10,000 copies. Then, the surface of the image bearer 1 was observed, but any filming substance was not found. Furthermore, after the 10,000 copies were obtained, the image bearer 1 was taken out and checked for the residual toner ID after the cleaning. The ID was equal to an initial ID and no deterioration was seen.

A blade cleaning device is used as a comparative example to carry out the similar experiment. A cleaning blade of the blade cleaning device is formed from Urethane rubber and has an intrusion amount of 1.05 mm, initial abutment angle of 79°, Young'modulus of 0.45, and free length of 8 mm. The cleaning blade is attached to a blade holder, and abuts the image bearer 1 with the aforementioned intrusion amount and abutment angle.

The initial cleaning residual toner ID of the image bearer 1 was 0.01. After 10,000 copies were obtained, a low image density was observed on a part of the image. Then, the image bearer 1 was taken out and checked, and the filming was seen to occur.

Figure 3:
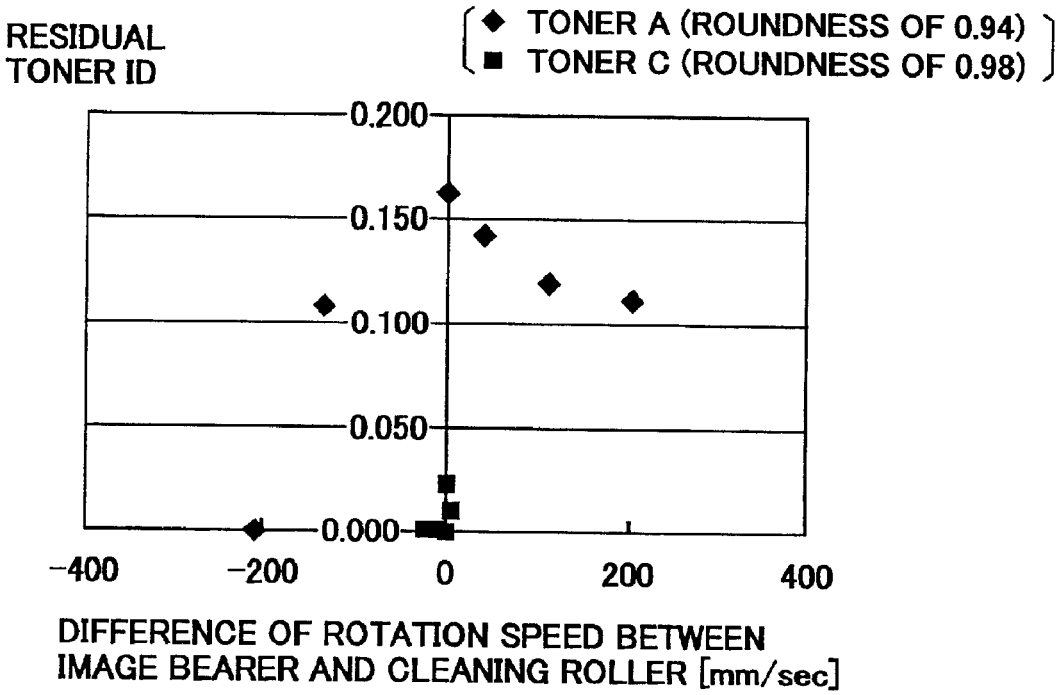
FIG. 3 is a graph showing a relationship between a residual toner ID and a difference of rotation speed between an image bearer and a cleaning roller.

Subsequently, a rotation speed difference is made between the cleaning roller 2 and the image bearer 1. The cleaning roller 2 is driven to rotate by a driving device (not shown) so that the cleaning roller 2 rotates at a rotation speed different from that of the image bearer 1. Further, the toner A and the toner C are used, and 500 V and 600 V are applied to the core metal 5 of the cleaning roller 2 for the toner A and the toner B, respectively. As a result, it can be seen from FIG. 3 that a removal efficiency of the residual toner from the surface of the image bearer 1 is enhanced. Furthermore, with a uniform toner shape and rate, a magnitude of a linear speed difference at which the removal efficiency is enhanced differs with the cleaning residual toner amount. However, it has also been seen that the removal efficiency of the transfer residual toner amount is enhanced at a speed difference of 1 to 10% with respect to the rotation speed of the image bearer 1.

As a confirmation experiment, the toner C was used to perform the image forming process including the steps of:

developing the latent image formed on the image bearer 1 with toner; transferring a toner image to a transfer material; and cleaning the image bearer 1 by the cleaning device 11, over the copy operation of 10,000 copies. Then, the surface of the image bearer 1 was observed, and any filming substance was not found. Further, after 10,000 copies were obtained, the image bearer 1 was taken out and checked for the cleaning residual toner ID. The ID was equal to the initial ID, and there was no deterioration.

Figure 4:
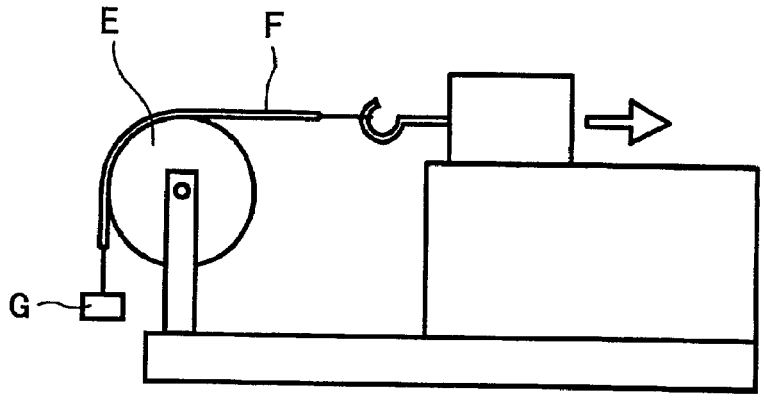
FIG. 4 is a schematic view for explaining a measuring method of a coefficient of static friction of the image bearer and a coefficient of static friction of the cleaning roller by an Euler belt system.

Subsequently, the cleaning roller 2 with a standard of coefficient of static friction $\mu$ assigned thereto was used to verify the cleaning property with the speed difference between the cleaning roller 2 and the image bearer 1. A coefficient of static friction $\mu_{OPC}$ of the image bearer 1, and coefficient of static friction $\mu_R$ of the cleaning roller 2 were measured by an "Euler belt system" illustrated in FIG. 4. Referring to FIG. 4, a character "E" denotes an object to be measured, "F" denotes paper, and "G" denotes a weight. The experiment conditions were set to: the speed difference of −207 mm/sec between the cleaning roller 2 and the image bearer 1 (i.e., speed of the image bearer 1: 94 mm/sec, the speed of the cleaning roller 2 in a counter direction: 113 mm/sec); image bearer coefficient of static friction $\mu_{OPC}$ of 0.375; and cleaning roller bias of 0 V.

As a result, when the coefficient of static friction $\mu$OPCof the surface of the image bearer 1 and the coefficient of static friction $\mu_R$ of the cleaning roller 2 satisfy the relation of $\mu_R > \mu_{OPC}$, the toner tends to adhere onto the cleaning roller 2 from the image bearer 1, so that the efficiency of removing the residual toner from the surface of the image bearer 1 is increased. In this example, the cleaning bias is not applied to the cleaning roller 2. However, by applying a proper cleaning bias to the cleaning roller 2, the speed difference between the cleaning roller 2 and the image bearer 1 may be minimized.

When the transfer voltage needs to be increased because of the environmental fluctuation and deterioration with the lapse of time, the charging polarity of the transfer residual toner turns to be positive as shown in Table 3. In this condition, the transfer residual toner having a positive polarity is not adequately removed from the image bearer 1 by the cleaning roller 2 with the bias having the positive polarity applied thereto.

TABLE 3

Transition of Toner Charging Amount after Each Process

| (1) Toner Q/M [$\mu$C/g] after development | (2) Transfer voltage [V] | (3) Transfer residual toner Q/M [$\mu$C/g] | (4) Toner passed through polarity control device Q/M [$\mu$C/g] |
|---|---|---|---|
| −26.8 | 1600 | −15.6 | −16.8 |
| −26.8 | 1850 | −8.2 | −13.5 |
| −26.8 | 2100 | −6.9 | −12.3 |
| −26.8 | 2350 | 1.9 | −11 |
| −26.8 | 2600 | 9.2 | −9.8 |

Figure 5:
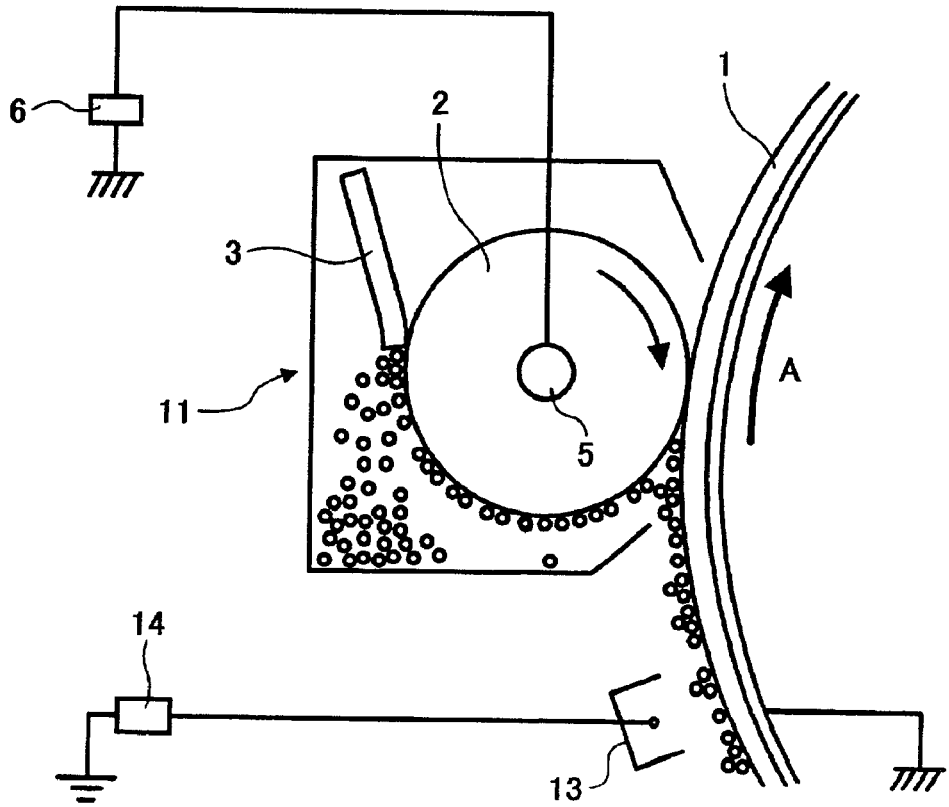
FIG. 5 is a schematic view of a part of the image forming apparatus of FIG. 2 in which a polarity control device is provided.

FIG. 5 is a schematic view of a construction of the image bearer 1 and the cleaning device 11 in which a polarity control device 13 is disposed before the cleaning process of the transfer residual toner by the cleaning roller 2. Specifically, the polarity control device 13 is provided downstream of a transfer position where the toner image is transferred to a transfer material by the transfer device 10 and upstream of a cleaning position where the cleaning roller 2 removes the transfer residual toner on the image bearer 1, in a moving direction of the image bearer 1. In the shown example, AC voltage of 100 $\mu$A and DC voltage of −60 $\mu$A are applied to a tungsten wire serving as the polarity control device 13 from a power supply 14, corona discharge is performed, and the negative charge is applied to the image bearer 1 and transfer residual toner. The transfer residual toner Q/M passed through the polarity control device 13 is shown in (4) of Table 3. When passing through the polarity control device 13, the transfer residual toner on the image bearer 1 is applied with a uniform negative polarity, and then reaches a position where the transfer residual toner opposes the cleaning roller 2.

When the direct current voltage is applied to the core metal 5 of the cleaning roller 2 from the power supply 6, the transfer residual toner adheres to the cleaning roller 2 by the electric field formed between the cleaning roller 2 and the image bearer 1. Therefore, the transfer residual toner is easily removed from the image bearer 1. As described above, the charging polarity of the transfer residual toner on the image bearer 1 is uniformly set to a polarity opposite to that of the voltage applied to the core metal 5 of the cleaning roller 2 by the polarity control device 13. Thereby, the transfer residual toner adjusted with the negative polarity can be electrostatically and efficiently removed from the surface of the image bearer 1 by the cleaning roller 2 with the positive-polarity voltage applied thereto.

As one non-limiting example of the polarity control device 13, a charging member including a brush to contact the transfer residual toner on the image bearer 1 may be used. The charging member is constructed so that a predetermined-polarity voltage is applied to the brush and the charging polarity of the transfer residual toner is adjusted with a predetermined polarity.

Figure 6:
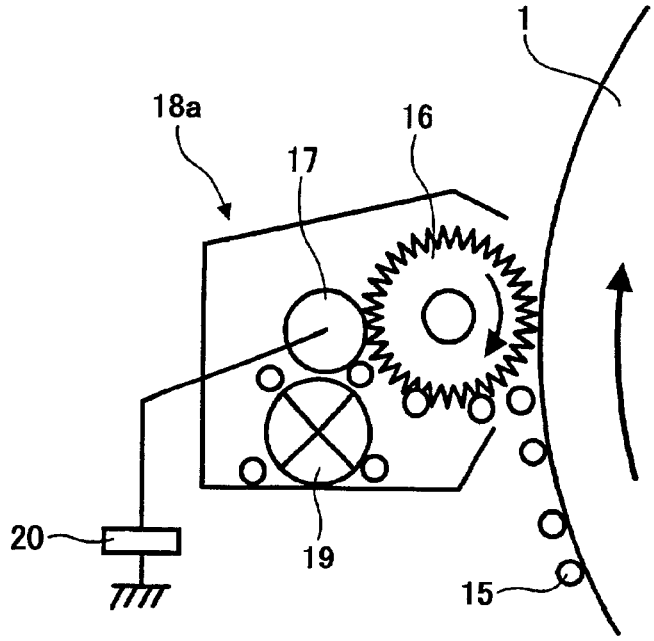
FIG. 6 is a schematic view of a construction of a cleaning device according to another embodiment of the present invention.

FIG. 6 is a schematic view of a construction of a cleaning device according to another embodiment of the present invention.

Referring to FIG. 6, residual toner 15 on the image bearer 1 is conveyed in a clockwise (CW) direction, and mechanically removed and dropped from the image bearer 1 by a brush roller 16 of a cleaning device 18A serving as a cleaning member which also rotates in the clockwise (CW) direction. The toner adhering to the brush roller 16 without dropping from the brush roller 16 is beaten off by a bias roller 17. In this case, the bias roller 17 may be either rotated or fixed.

The toner dropped from the brush roller 16 or the bias roller 17 is collected in a developing tank by a collection roller 19 disposed in the cleaning device 18A, and reused. Alternatively, in order to stabilize the system, the toner may be collected and discarded in a waste toner bottle.

The transfer residual toner to be removed from the image bearer 1 sometimes has polarity. Therefore, when the bias from a transfer bias power supply 20 is applied to the bias roller 17 and to a brush tip end of the brush roller 16, a static force is applied as well as a mechanical force by the brush of the brush roller 16, thereby further improving the cleaning property.

In the cleaning device 18A, the bias is applied to the brush roller 16 via the bias roller 17, but may directly be applied to the core metal of the brush roller 16. Examples of the bias from the transfer bias power supply 20 include a DC voltage having the polarity reverse to the polarity of the toner, AC voltage, and DC voltage with AC voltage superimposed thereupon. When the bias is applied, the toner having the different polarity on the image bearer 1 is electrostatically attracted by the brush roller 16. Moreover, when the AC voltage is applied, the polarity of the toner is removed, and the toner is removed from the image bearer 1 by the mechanical force of the brush of the brush roller 16.

Further, for example, when a conveyance trouble (e.g., a sheet jam) of a transfer material occurs and when the operation of an image forming apparatus is resumed after removing a jammed transfer material, the toner image on an image bearer not having been transferred to the transfer material sometimes enters a cleaning device. In this case, because the toner amount is relatively large, all the toner cannot be sometimes removed by a cleaning member. However, in the case of the brush roller 16, the brush of the brush roller 16 contacting the image bearer 1 scatters the toner, thereby effectively avoiding the stain of a background image of the subsequently formed toner image. Moreover, the brush roller 16 advantageously has a cost lower than that of the elastic cleaning roller 2 of FIG. 1.

Both the cleaning roller 2 of FIG. 1 and the brush roller 16 of FIG. 6 are rotatably supported in the cleaning devices 11 and 18*a*, respectively, and rotation directions of the cleaning roller 2 and the brush roller 16 may be either one of the clockwise and counterclockwise directions in FIGS. 1 and 6.

When the cleaning roller 2 and the brush roller 16 rotate in the counterclockwise directions, the moving direction of the cleaning member is the same as the moving direction of the image bearer 1 at a position where the cleaning member contacts the image bearer 1. Further, when the moving speed of the cleaning member is different from the moving speed of the image bearer 1 at the position where the cleaning member contacts the image bearer 1, a slide friction force between the cleaning member and the surface of the image bearer 1 is increased, and the removal efficiency of the transfer residual toner can be enhanced.

Similarly, even when the cleaning roller 2 and the brush roller 16 rotate in the clockwise directions, the slide friction force between the cleaning member and the surface of the image bearer 1 is increased, and the removal efficiency of the transfer residual toner can be enhanced.

Further, the cleaning roller 2 and the brush roller 16 may be constructed to contact the surface of the image bearer 1, and to rock in an axial direction of the image bearer 1 by a driving device. In this construction, even when a large amount of transfer residual toner locally adheres to the image bearer 1, the toner can be diffused by the rocking cleaning member, and the surface of the image bearer 1 is uniformly cleaned. The details of the driving device that allows the cleaning member to rock will be described later.

Figure 7:
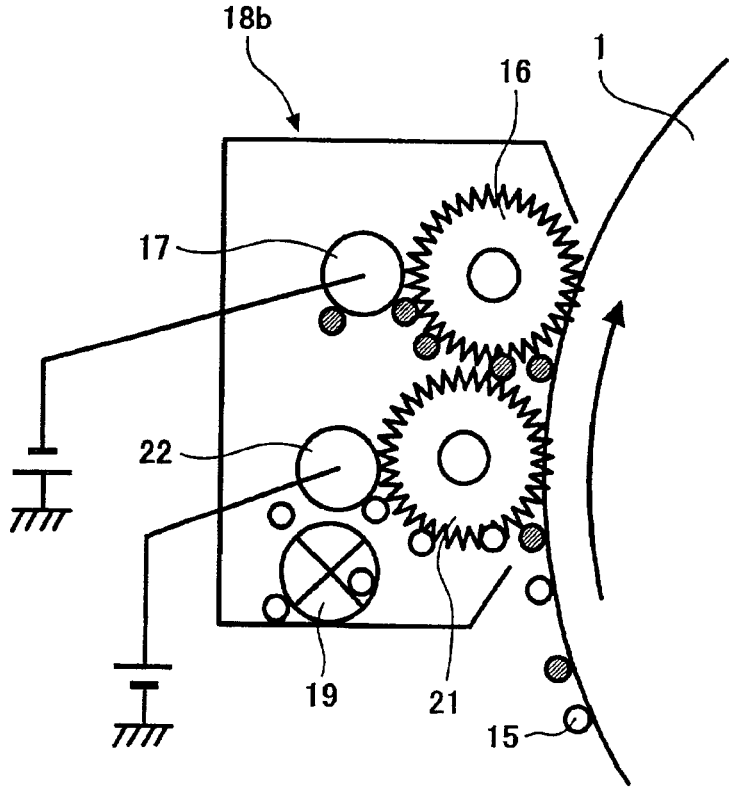
FIG. 7 is a schematic view of a construction of a cleaning device according to another embodiment of the present invention.

FIG. 7 is a schematic view of a construction of a cleaning device according to another embodiment of the present invention.

In the transfer process, when a high voltage is applied, a toner image on the image bearer 1 is electrostatically transferred to a recording sheet, or an intermediate transfer medium for use in color image formation. In this case, a discharge phenomenon sometimes occurs between the image bearer 1 and a transfer electrode. The toner having a small charging amount or the toner having an abnormal polarity sometimes has its polarity reversed by the electric discharge. Thereby, the transfer residual toner has a non-uniform polarity. That is, the positive-polarity toner is mixed in the toner having a negative-polarity by the developing.

To prevent this, and to apply the uniform polarity, a pretreatment charging process is provided before the cleaning process in a conventional method. In this charging process, because a high voltage is directly applied to the image bearer 1, ozone and nitrogen oxide are generated. Influences of these products onto environments and human bodies have been regarded as problems. Moreover, the nitrogen oxide adheres to the surface of the image bearer 1 and causes image deterioration.

Therefore, bias voltages suitable for the respective polarities are applied without uniforming the polarity by the charging as a pretreatment process, so that the transfer residual toner having each polarity is collected. Specifically, in a cleaning device 18B of FIG. 7, a bias having the positive polarity is applied to the brush roller 16, and a bias having the negative polarity is applied to a brush roller 21 serving as another cleaning member provided upstream of the brush roller 16 in the rotational direction of the image bearer 1. With the above-described construction of the cleaning device 18B, the residual toner having mixed polarities may be removed from the image bearer 1 by the cleaning device 18B.

Figure 8:
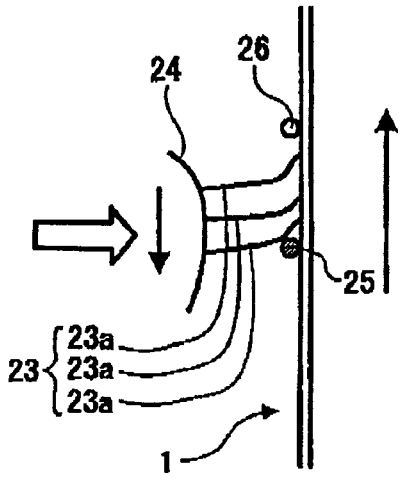
FIG. 8 is a schematic view illustrating a state of removing a residual toner on an image bearer by a brush roller of the cleaning device of FIG. 7.

FIG. 8 is a schematic view illustrating a state of removing a residual toner on the image bearer 1 by the brush roller 16.

The brush roller 16 is constructed by winding a brush 23 planted on a fabric base around the surface of a core metal 24 in a spiral form. As the fabric base, a polyester-based nylon-based material is generally used. The brush 23 has a straight or loop shape, a density of 50,000 to 150,000 bristles/inch$^2$, and planting pitch of 0.7 mm to 0.9 mm. Therefore, a material bristle bundle of 30 to 50 bristles 23*a* is planted in one planted portion.

The material bristle 23*a* includes carbon-containing acryl fiber having a thickness of 15 to 30 $\mu$m. The fiber is set so as to intrude into the image bearer 1 by an intrusion amount of about 1 mm. So, the fiber is in a bending state.

Figure 9:
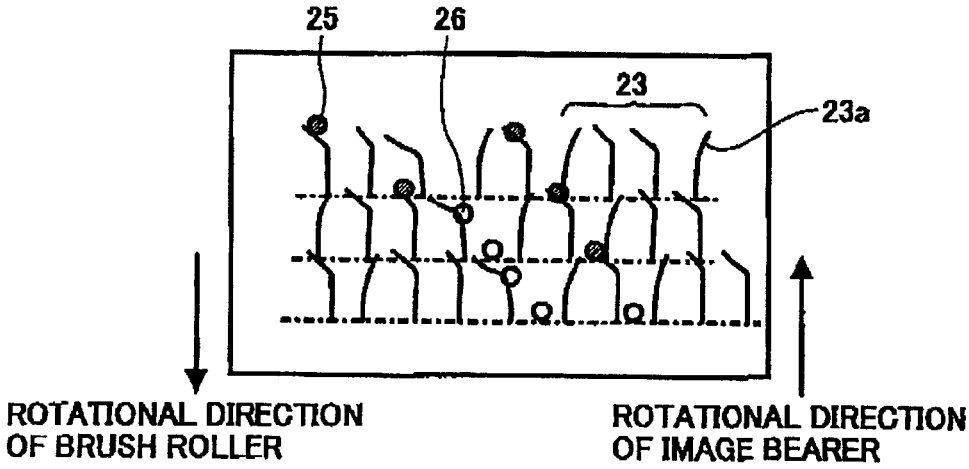
FIG. 9 is a schematic view of the brush roller of FIG. 8 seen from a direction perpendicular to an axial direction of the brush roller.
Figure 10:
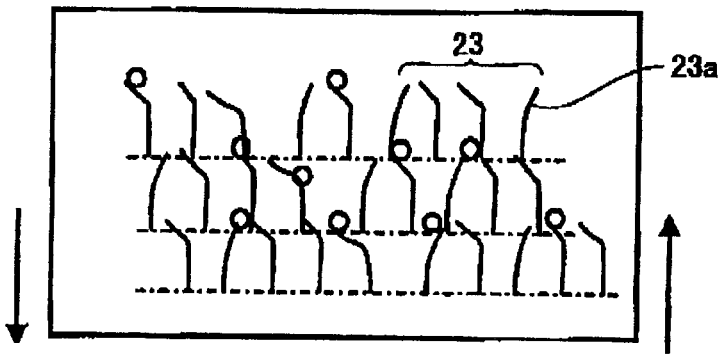
FIG. 10 is a schematic view of the brush roller of FIG. 8 seen from a direction perpendicular to the axial direction of the brush roller in which each bristle is planted in an interval between the bristles of the previous row.

FIG. 9 is a schematic view of the brush roller of FIG. 8 seen from a direction perpendicular to an axial direction of the brush roller. Referring to FIG. 9, in a portion of the brush roller 16 where the brush 23 is planted, toner 25 is caught on the tip end of the brush 23. However, toner 26 slips through an interval between the bristles 23*a* of the brush 23. In order to improve this, as illustrated in FIG. 10, in the next row, the bristle 23*a* is planted in the interval between the bristles 23*a* of the previous row, so that the slipped toner is captured and the image bearer 1 is cleaned.

Figure 11:
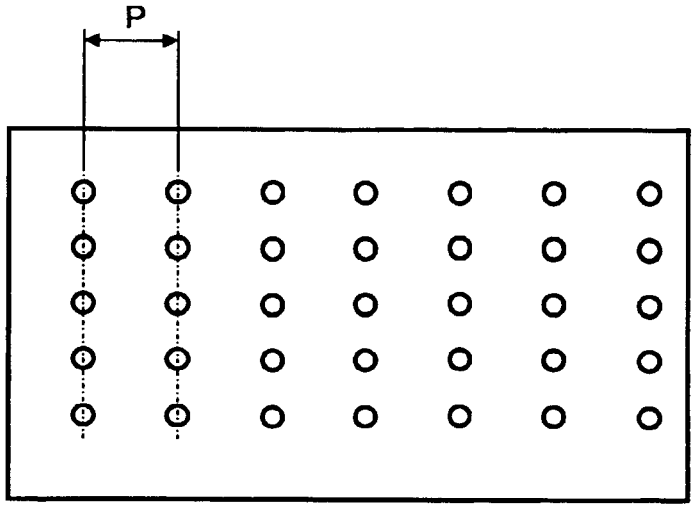
FIG. 11 PRIOR ART
FIG. 11 is a schematic view for explaining a conventional planted state of bristles of a brush roller.
Figure 12:
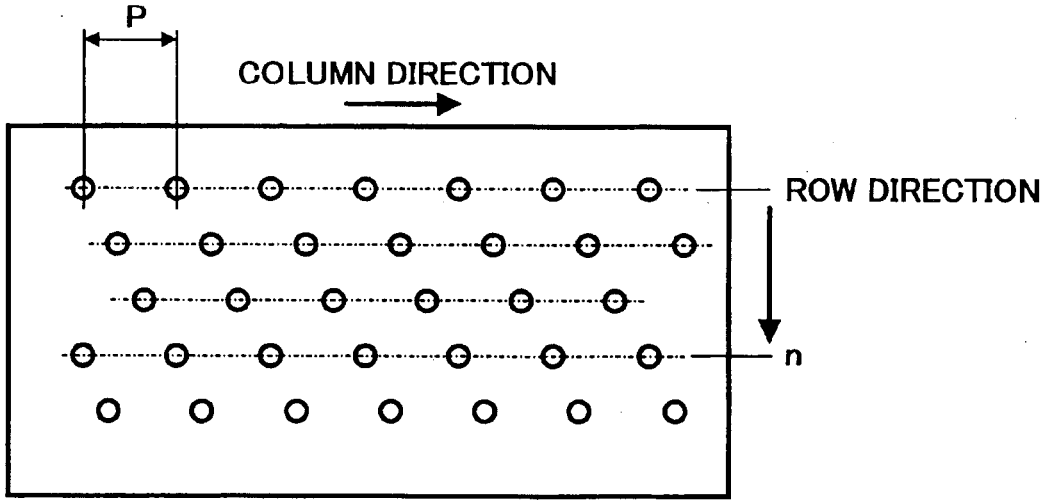
FIG. 12 is a schematic view for explaining another planted state of bristles of a brush roller.

FIG. 11 is a schematic view for explaining a conventional planted state of bristles of a brush roller. Bristles are arranged in a grid pattern having a constant pitch both in a row and column. The planted fabric base is formed from wound piles each having a constant width of 15 mm to 20 mm, but a planting pitch interval is not filled. In order to fill the planting pitch interval, as illustrated in FIG. 12, assuming that a planting pitch is "P" and bristle diameter is "d" in a column direction, and that the number of rows having the bristles in the same positions is "n" in a row direction, the following condition is satisfied:

$$d>P/n.$$

Figure 13:
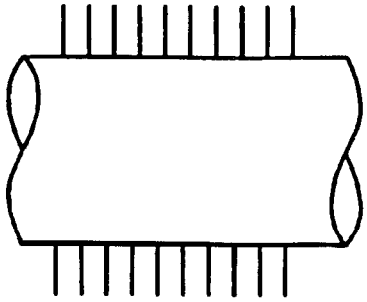
FIG. 13 is a partially enlarged view of the brush roller of FIG. 8.
Figure 14:
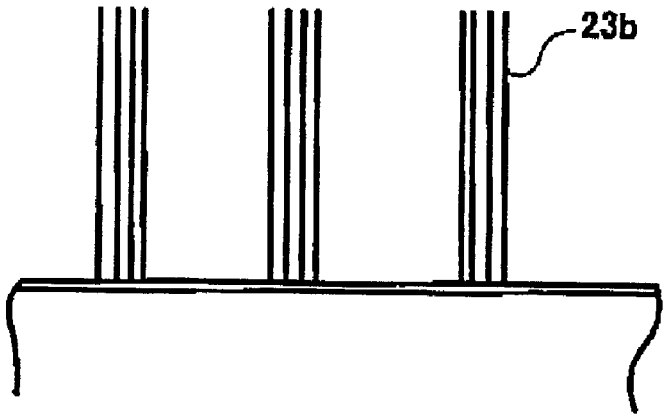
FIG. 14 is a partially enlarged view of a conventional brush roller.
Figure 15:
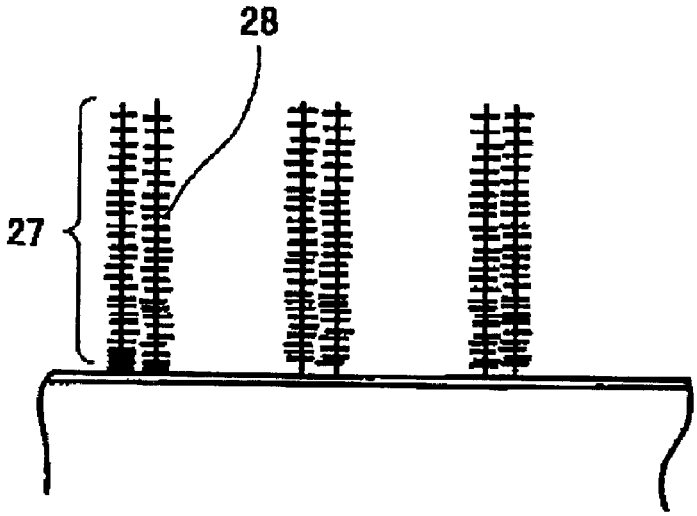
FIG. 15 is a partially enlarged view of the brush roller of FIG. 13.

Thereby, slipped toner is brought into contact with the brush, and the residual toner is securely caught or scraped off. As illustrated in FIG. 13, the brush roller 16 includes bundled material bristles 23*a* having a bristle length of about 5 mm. If this material bristle is a linear fiber as illustrated in FIG. 14, and just contacts spherical toner, the toner slips through, thereby causing a cleaning defect. To prevent this, as illustrated in FIG. 15, a sub bristle 28 for capturing the toner is attached to a linearly planted main bristle 27. The sub bristle 28 has a length of 0.05 mm to 0.1 mm, and has a slight branch-shaped protrusion attached thereto, so that rolled and escaping toner from the brush is eliminated, and the residual toner securely abuts the brush and is removed from the surface of the image bearer 1.

Figure 16:
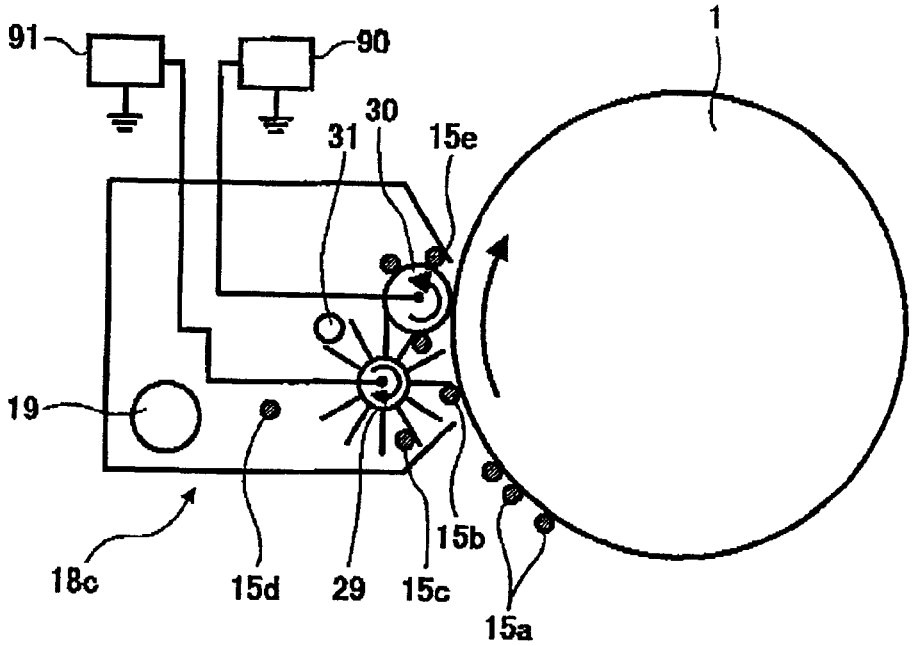
FIG. 16 is a schematic view of a construction of a cleaning device according to another embodiment of the present invention.
Figure 17:
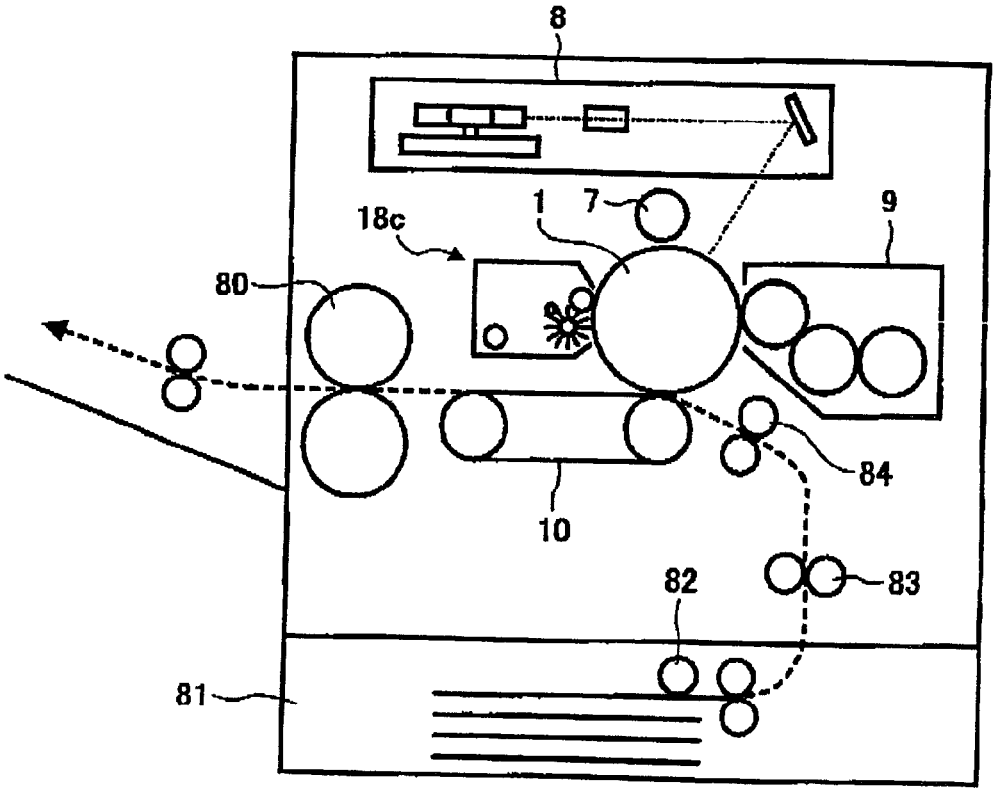
FIG. 17 is a schematic view of an overall construction of an image forming apparatus including the cleaning device according to the embodiment of the present invention.

FIG. 16 is a schematic view of a construction around a cleaning device of an image forming apparatus according to another embodiment of the present invention. FIG. 17 is a schematic view of an overall structure of an image forming apparatus including the cleaning device of FIG. 16.

According to the embodiment, in a cleaning device 18C, a cleaning brush 29 serving as a cleaning member is disposed in a slide contact with both the image bearer 1 and a cleaning roller 30 serving as a cleaning member. Therefore, an amount of the residual toner reaching the cleaning roller 30 is largely reduced by a primary cleaning effect by the cleaning brush 29. Further, the toner can be scraped from the cleaning roller 30 without adding any scraper or any exclusive-use cleaning brush. Therefore, the cleaning device 18C using the cleaning roller 30 having a high capability can be reduced in size and cost.

When the cleaning roller 30 is rotated in a counter direction with respect to the image bearer 1, the toner not scraped from the cleaning roller 30 by the cleaning brush 29 is moved into a wedge-shaped region on the downstream side of the cleaning roller 30. In this case, when the toner is attached to the image bearer 1 by an electrostatic or mechanical force in the wedge-shaped region, the toner is conveyed to the charging device 7. In this embodiment, however, the cleaning roller 30 is rotated in a trailing direction with respect to the image bearer 1. Therefore, the non-scraped toner moves to the upstream side of the cleaning roller 30 again, and undergoes the cleaning action of the cleaning roller 30 again. This prevents the cleaning property of the cleaning device 18C from being deteriorated.

When the rotational direction of the cleaning roller 30 is set to the direction counter to that of the image bearer 1, a mechanically acting force of the cleaning roller 30 increases. As a result, an effect that the toner is mechanically scraped off can be obtained. However, in this construction, when the amount of the toner is small, the surface of the cleaning roller 30 slides on the surface of the image bearer 1 with a large peripheral speed difference, thereby abrading the surface of the image bearer 1. As a result, the image bearer 1 is worn, so that the durability of the image bearer 1 decreases.

In this embodiment, by rotating the cleaning roller 30 in a trailing direction with respect to the image bearer 1, the peripheral speed difference between the cleaning roller 30 and the image bearer 1 is eliminated. Further, when the peripheral speed difference is set to 10% or less of the speed of the image bearer 1, the effect of mechanically scraping off the toner is imparted to the cleaning roller 30, and both the cleaning performance of the cleaning device 18C and the durability of the image bearer 1 can be enhanced.

According to the experiments by the present inventors, it has been seen that the effect of mechanically scraping off the toner can be enhanced with the peripheral speed difference of only about several percentages. Therefore, in consideration of the durability of the image bearer 1, the device is set so as to operate with the difference of 10% or less. The device is thereby constructed, while the peripheral speed difference is as small as possible.

Further, in this embodiment, as described above, the cleaning brush 29 is used to scrape off the toner from both the image bearer 1 and the cleaning roller 30. Therefore, when the cleaning brush 29 passes a flicker bar 31, the amount of toner adhering to the cleaning brush 29 decreases, and the brush tip end having the cleaning ability restored slides on the cleaning roller 30 with a small amount of removed toner adhering thereto. Then, the cleaning brush 29 effectively scrapes off the adhering toner from the cleaning roller 30. After the adhering toner amount slightly increases, the cleaning brush 29 is used to scrape off a relatively large amount of toner adhering to the image bearer 1. With the above-described construction of the cleaning device 18C, the cleaning performance of the cleaning device 18C is enhanced.

Further, because the cleaning brush 29 is rotated in the counter direction and the cleaning roller 30 is rotated in the trailing direction with respect to the image bearer 1, the trailing direction is set between the cleaning brush 29 and the cleaning roller 30, and a rubbing speed of the cleaning brush 29 against the cleaning roller 30 is obtained by the speed difference between the cleaning brush 29 and the cleaning roller 30. In this embodiment, the rubbing speed of the cleaning brush 29 against the cleaning roller 30 is set to 10% or less of the peripheral speed of the cleaning roller 30. As a result, the decrease of the durability of the cleaning roller is restrained. In addition, the cleaning performance of the cleaning brush 29 for the image bearer 1 is maintained.

As the image bearer 1, an organic photosensitive roller using a resin material is often employed, and a surface hardness of the organic photosensitive roller is much higher than that of the cleaning roller 30 formed from hydrin rubber or the like. Therefore, when the cleaning brush 29 is in the slide contact, the cleaning brush 29 slides on the image bearer 1 at a high speed in order to preferentially enhance the cleaning capability. The cleaning brush 29 preferably slides on the cleaning roller 30 at a low speed in consideration of strength of the material.

As described above, the cleaning roller 30 and cleaning brush 29 are rotated in the trailing direction. Therefore, in this construction, even when the cleaning brush 29 is used to scrape off the toner from both the image bearer 1 and the cleaning roller 30, the durability of the cleaning roller 30 is not deteriorated.

The cleaning roller 30 is constructed such that the electric field of a direction for absorbing the toner by a bias device 90 is generated in an abutment portion with the image bearer 1. The cleaning roller 30 has a function of attracting the toner to the cleaning roller 30 from the image bearer 1 by an electrostatic adsorption force. Because this acting force is exerted regardless of the toner shape, even the spherical dry toner can be easily removed from the image bearer 1.

In a conventional cleaning method using a cleaning blade, a spherical toner is difficult to be removed from an image bearer. According to the embodiments of the present invention, a spherical toner is adequately removed from the image bearer 1 by the cleaning device without using a cleaning blade. With the above-described construction of the cleaning device, the image forming apparatus using a spherical toner for development can be compact and low cost and has high image quality.

Moreover, when the image bearer 1 with a reinforced filler dispersed therein is used, the cleaning cannot be sometimes performed in the cleaning method using a cleaning blade. According to the embodiments of the present invention, the cleaning of the image bearer 1 with the reinforced filler dispersed therein is performed by the cleaning device without using the cleaning blade. With the above-described construction of the cleaning device, the image forming apparatus using the image bearer 1 with the reinforced filler dispersed therein can be compact and low cost and has high durability.

Further, in this embodiment, a bias voltage of different polarity is applied to each of the cleaning brush 29 and the cleaning roller 30. Specifically, for example, a bias voltage of a negative polarity is applied to the cleaning brush 29 by a bias device 91, and a bias voltage of a positive polarity is applied to the cleaning roller 30 by the bias device 90. With this construction of the cleaning device 18*c*, the residual toner is surely removed from the image bearer 1 by the cleaning brush 29 or the cleaning roller 30 irrespective of the charging polarity of the toner.

Referring to FIG. 16, a reference numeral 15*a* denotes transfer residual toner, a reference numeral 15*b* denotes the toner removed by the cleaning brush 29, a reference numeral 15*c* denotes the toner attached/carried onto the cleaning brush 29, a reference numeral 15*d* denotes the toner dropped by collision against the flicker bar 31, and a reference numeral 15*e* denotes the toner removed by the cleaning roller 30.

Referring to FIG. 17, the image forming apparatus includes the image bearer 1, the charging device 7 that charges the image bearer 1, the exposing device 8 that forms an electrostatic latent image on the image bearer 1, the developing device 9 that develops the electrostatic latent image on the image bearer 1 with toner into a toner image, the transfer device 10 that transfers the toner image onto a transfer material, and the cleaning device 18C that removes residual toner from the image bearer 1 after the toner image is transferred onto the transfer material.

The image forming apparatus of FIG. 17 further includes a fixing device 80 that fixes the transferred image on the transfer material, a sheet feeding cassette 81 that contains the transfer material, a sheet feeding roller 82 that feeds out the transfer material from the sheet feeding cassette 81, a pair of transfer material conveying rollers 83 that conveys the transfer material, and a pair of registration rollers that feed out the transfer material at an adjusted timing for the toner image on the image bearer 1.

Figure 18:
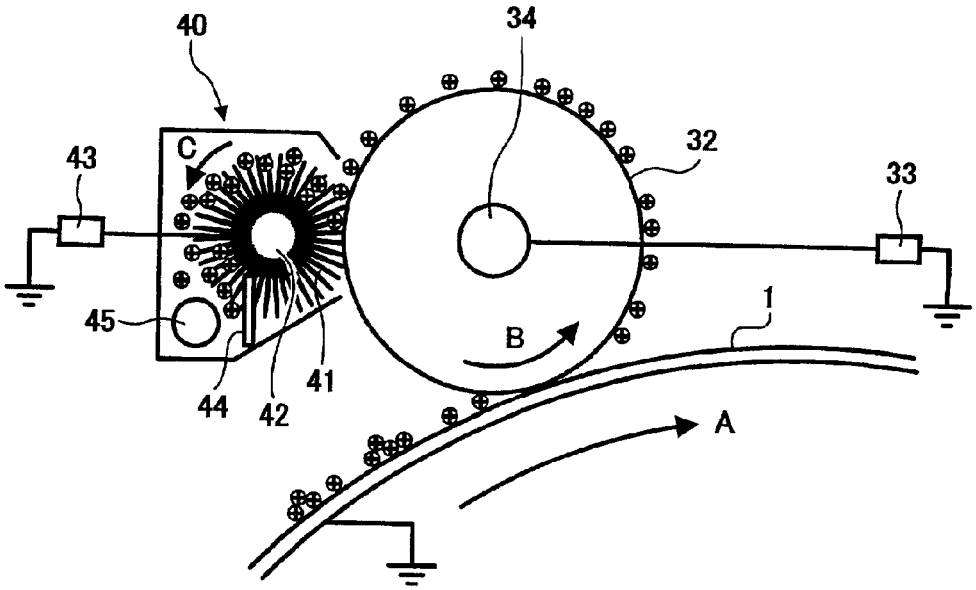
FIG. 18 is a schematic view of a construction of a cleaning device according to another embodiment of the present invention.

FIG. 18 is a schematic view of a construction around a cleaning device of an image forming apparatus according to another embodiment of the present invention.

In this embodiment, a cleaning device 40 includes a conductive cleaning roller 32 of an elastic material that also serves as a charging device for the image bearer 1. By use of the cleaning roller 32 that also serves as the charging device for the image bearer 1, the size and cost of the image forming apparatus can be decreased. The charging and cleaning roller 32 is disposed in contact with the image bearer 1, and rotates in a direction of an arrow B. The charging and cleaning roller 32, to which the voltage is applied from a power supply 33, charges the image bearer 1 at a predetermined polarity and potential. In this embodiment, the image bearer 1 is uniformly charged with a negative polarity.

In this embodiment, a spherical dry toner is used which contains at least modified polyester having a urea bond as a toner binder, and contains a wax finely dispersed in the spherical dry toner. The toner image produced by this spherical dry toner has a gloss of 5% to 30% even when the temperature of the fixing member varies within 50 degrees (e.g., from 100 degrees to 150 degrees).

When the spherical dry toner is removed from an image bearer with a cleaning blade, the toner is collected in the abutment portion formed by the surfaces of the cleaning blade and image bearer in a densely filled state. A first layer of toner directly contacting the image bearer filled in a most densely manner has a strong adhesion force with respect to the image bearer. Therefore, during the cleaning by the cleaning blade, the toner slips between the first layer and a second layer. The first layer pushes up a tip edge of the cleaning blade, slips through the cleaning blade, and remains on the image bearer. This results in a cleaning defect.

Therefore, when the cleaning blade is used to remove the spherical dry toner from the image bearer, the abutment force of the cleaning blade against the image bearer needs to be increased in order to prevent the above-described cleaning defect. However, in this case, a large stress is applied to the toner in the portion in which the cleaning blade contacts the image bearer, and thereby the wax in the toner bleeds out and adheres to the image bearer. As a result, a wax filming may occur.

To solve the above-described problem, the cleaning device 40 according to the embodiment of the present invention employs the cleaning roller 32 of an elastic roller as a charging and cleaning member to which the voltage is applied from the power supply 33. With the use of the cleaning roller 32, even when the toner containing the polyester-based toner binder having a small particle diameter, spherical shape, and melt viscosity lower than that of the conventional toner is used in the image forming apparatus, the toner is surely removed from the image bearer 1 without causing wax filming to occur.

Specifically, the cleaning roller 32 has an elastic conductive layer around a core metal 34. The elastic conductive layer is made of elastic materials such as polyurethane rubber, silicon rubber, and bradiene rubber, in which conductive fine particles formed of carbon black, oxides of metals such as titanium and aluminum, an ion conductive agent, and the like are dispersed. Further, an intermediate resistance layer is formed on the surface of the cleaning roller 32 in order to prevent the bias current from leaking to the image bearer 1 because of a pinhole in the surface of the image bearer 1. In addition, a surface protective layer may be provided on the intermediate resistance layer to prevent stains on the surface of the cleaning roller 32. In this embodiment, a cleaning roller whose volume resistivity is adjusted in a range of $10^6$ to $10^{12}$ Ω•cm is used as the cleaning roller 32.

The power supply 33 is connected to the core metal 34. The voltage is applied to the cleaning roller 32 from the power supply 33, and thereby the residual toner on the image bearer 1 is attracted toward the cleaning roller 32 by an electrostatic force. While the cleaning roller 32 rotates, the residual toner on the image bearer 1 is removed therefrom.

In this embodiment, the image bearer 1 is negatively charged, and the negatively charged toner is attached to an exposed portion of the image bearer 1. Because a so-called negative/positive developing method is employed in the image forming apparatus, the toner adhering onto the image bearer 1 has a negative polarity after developing the image. Therefore, a positive voltage or current is applied to the transfer device, and thereby the toner having the negative polarity is transferred to the transfer material. As a result, the polarity of the transfer residual toner on the image bearer 1 is reversed by the influence of the transfer bias, so that the transfer residual toner on the image bearer 1 becomes positively charged toner. Therefore, when the negative voltage is applied to the cleaning roller 32, the positively charged transfer residual toner on the image bearer 1 is attracted to the cleaning roller 32.

Figure 19:
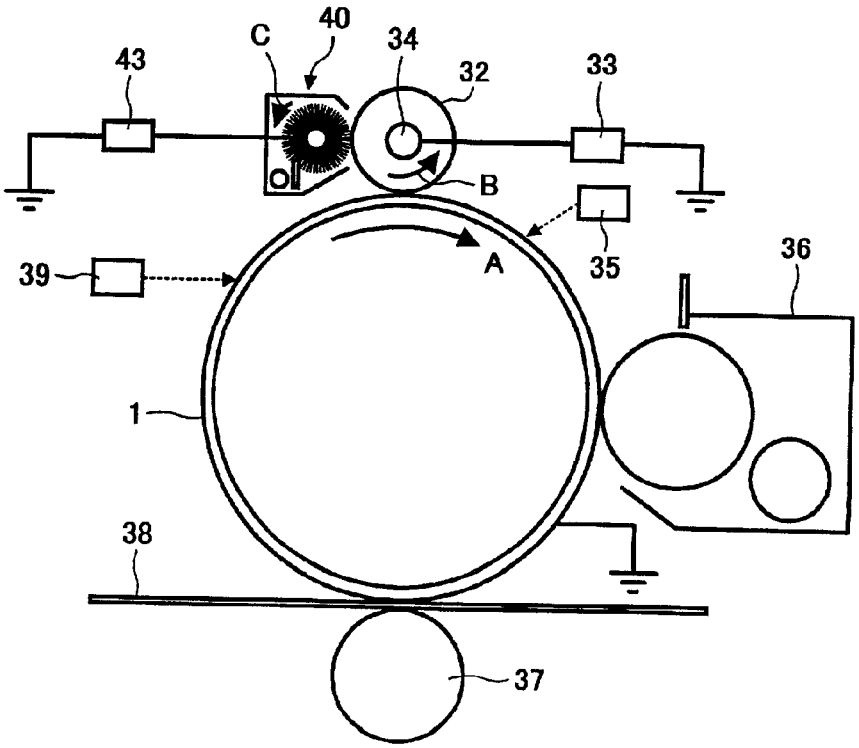
FIG. 19 is a schematic view of a main part of an image forming apparatus including the cleaning device of FIG. 18.

Specifically, as illustrated in FIG. 19, when a voltage of −1300 V is applied to the core metal 34 of the cleaning roller 32 from the power supply 33, the image bearer 1 is uniformly charged at −700 V by the electric discharge. Moreover, the uniformly charged surface of the image bearer 1 is exposed to laser light emitted from an exposing device 35 in accordance with input image data, and the surface potential of the exposed image bearer 1 is set to −100 V. A voltage of −400 V is applied to a developing roller in a developing device 36 holding the developer, and the toner having a negative polarity is attached to the developing roller to develop an electrostatic latent image on the image bearer 1 into a toner image. The toner of the toner image on the image bearer 1 is transferred to a transfer material 38 by applying a voltage of +1500 V to a transfer roller 37 of a transfer device, and the transfer residual toner having a positive polarity remains on the image bearer 1.

The surface potential of the image bearer 1 is influenced by the transfer process, but the surface potential is set to 0 V by a discharging light of a discharging device 39. Further, in the cleaning process, the transfer residual toner having the positive polarity is electrostatically removed by the cleaning roller 32 with −1300 V applied thereto, and the image bearer 1 is charged again at −700 V.

Figure 20:
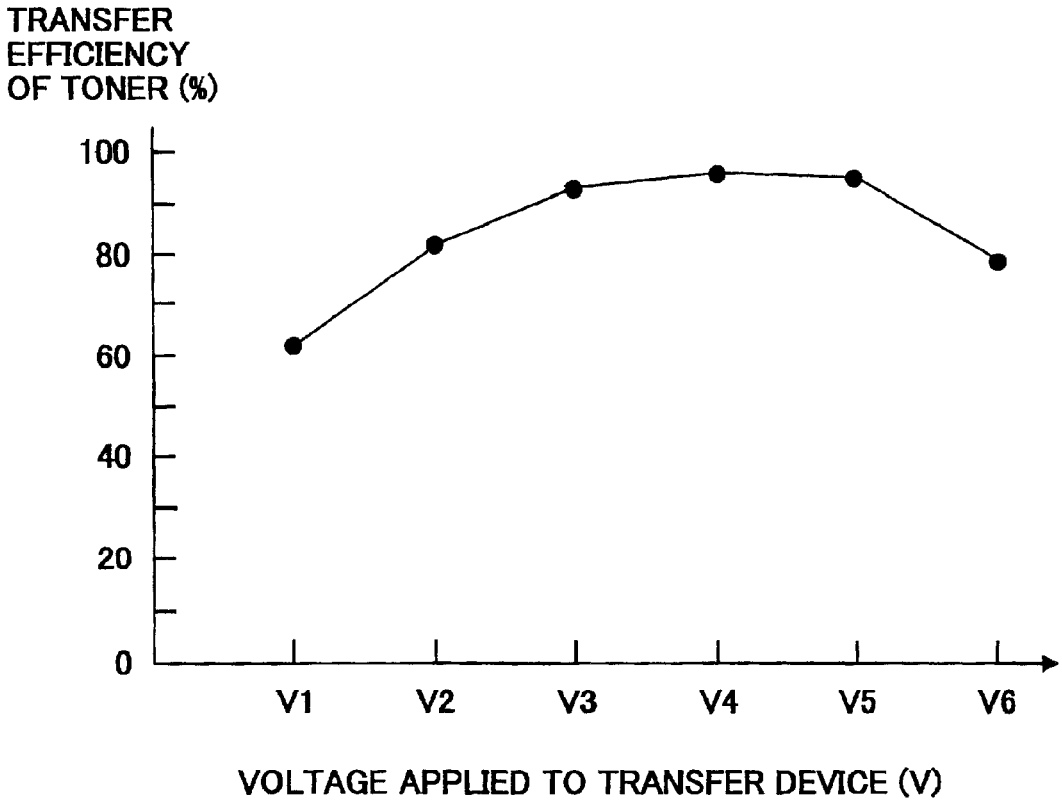
FIG. 20 is a graph showing a relationship between a transfer efficiency of toner and a voltage applied to a transfer device.

In this embodiment, the image forming apparatus uses a spherical dry toner. FIG. 20 is a graph showing a relationship between transfer efficiency of toner and a voltage applied to the transfer device. The transfer efficiency of toner is measured by an experiment using the spherical dry toner. This result shows that the transfer efficiency of toner of substantially 100% is obtained by applying a proper voltage to the transfer device, and the adhering amount of the transfer residual toner onto the image bearer 1 is extremely small.

Therefore, when the spherical dry toner is used in the image forming apparatus, the amount of the transfer residual toner to be removed by the cleaning roller 32 is extremely small, so that a charging property of the cleaning roller 32 to the image bearer 1 is not typically deteriorated.

However, in order to measure the adhering amount of the toner to the image bearer 1, a solid image having a certain pattern is developed with toner, and the solid toner image is exposed to light, and then the toner adhering amount is calculated from a light reflected from the solid toner image. In this case, because the solid toner image is not transferred to a transfer material, the toner of the solid toner image enters the cleaning roller 32 as such.

Therefore, in the cleaning device 40 of FIG. 18, a brush roller 41 is used as a toner removing device in order to remove the toner collected by the cleaning roller 32. The brush roller 41 is formed by spirally winding a tape having a pile fabric of conductive rayon fiber as a brush portion around a core metal 42 which also serves as an electrode. The brush of the brush portion has a thickness of 300 deniers/50 filaments and a density of 80 to 600 bristles per square millimeter. The brush roller 41 is rotated in one direction, and the brush is set coaxially with the core metal 42. A bristle length is preferable in a range of 1 mm to 10 mm.

The brush roller 41 is driven to rotate with a predetermined peripheral speed in a direction (direction C of FIGS. 18 and 19) reverse to the rotational direction of the cleaning roller 32, and brought into contact with the cleaning roller 32 with a speed difference. With this construction of the cleaning roller 32 and the brush roller 41, the effect of removing the toner adhering to the cleaning roller 32 increases. Further, the brush roller 41 is constructed such that the voltage is applied to the core metal 42 from a power supply 43.

In this embodiment, the bias, in which an alternating current voltage is superimposed upon a direct current voltage, is applied to the brush roller 41 from the power supply 43. The toner on the cleaning roller 32 removed from the image bearer 1 is allowed to vibrate, so that a toner removing capability from the cleaning roller 32 is enhanced.

Specifically, because the transfer residual toner having the positive polarity is removed from the image bearer 1 by applying a voltage of −1300 kV to the core metal 34 of the cleaning roller 32 from the power supply 33, a further large negative voltage is applied to the core metal 42 of the brush roller 41. Particularly, the bias of an alternating current voltage of 500 V to 1000 V (peak-to-peak voltage) superimposed on a direct current voltage of −1600 V is applied to the core metal 42 from the power supply 43. By applying the above-described voltage to the core metal 42 of the brush roller 41, the brush roller 41 efficiently removes the toner from the cleaning roller 32 by the electrostatic force without giving much stress against the toner.

The toner removed by the brush roller 41 is collected from the brush roller 41 by a scraper 44. Subsequently, the toner is conveyed to a waste toner accommodation bottle (not shown) as waste toner by a toner conveying screw 45, and collected by a maintenance person for disposal, or conveyed as recycle toner into the developing device 36.

The occurrences of a cleaning defect and wax filming were checked based on the number of printed sheets in the image forming apparatus including the cleaning device 40 having the charging and cleaning roller 32 of this embodiment and the image forming apparatus including a cleaning device using a cleaning blade. As the filming of the wax of toner adheres to a surface of an image bearer, the coefficient of static friction $\mu$ of the image bearer was measured and used as a substitute property. The coefficient of friction of the surface of the image bearer was measured by the "Euler belt system" illustrated in FIG. 4. Moreover, for the image forming apparatus using the charging and cleaning roller 32, the influence of the stain of the charging and cleaning roller 32 on the charging was also checked.

As shown in Table 4, when the cleaning device using the cleaning blade is used, the coefficient of friction of the surface of the image bearer increases due to the occurrence of the wax filming. On the other hand, when the cleaning device 40 including the charging and cleaning roller 32 is used, good quality images are obtained without occurrences of the cleaning defect and wax filming.

TABLE 4

| Number | Roller cleaning | | | Blade cleaning | |
|---|---|---|---|---|---|
| of Printed sheet A4 in portrait | Cleaning defect | Image bearer friction coefficient $\mu$ | Charging potential change (V) | Cleaning Detect | Image bearer friction coefficient $\mu$ |
| 0 | None | 0.42 | 0 | None | 0.42 |
| 10,000 | None | 0.44 | 0 | None | 0.40 |
| 50,000 | None | 0.46 | 0 | None | 0.32 |
| 100,000 | None | 0.46 | 0 | None | 0.28 |
| 150,000 | None | 0.46 | 0 | None | 0.26 |
| 200,000 | None | 0.48 | 0 | None | 0.26 |
| 250,000 | None | 0.48 | 0 | None | 0.26 |
| 300,000 | None | 0.49 | 0 | None | 0.26 |
| 350,000 | None | 0.49 | 0 | None | 0.26 |

Next, descriptions will be made to the charging device 7 of the image forming apparatus referring to FIGS. 21 through 26. The charging device 7 illustrated in FIG. 21 includes a charging member 101 arranged opposite to the surface of the image bearer 1, and a power supply 102 for applying a voltage to the charging member 101. The charging voltage is applied to the charging member 13 by the power supply 14, and thereby electric discharge is caused between the charging member 101 and the surface of the image bearer 1, and the surface of the image bearer 1 is charged with a predetermined polarity. As the charging voltage, a direct current voltage, or a voltage in which an alternating current voltage is superimposed upon a direct current voltage is used.

Figure 21:
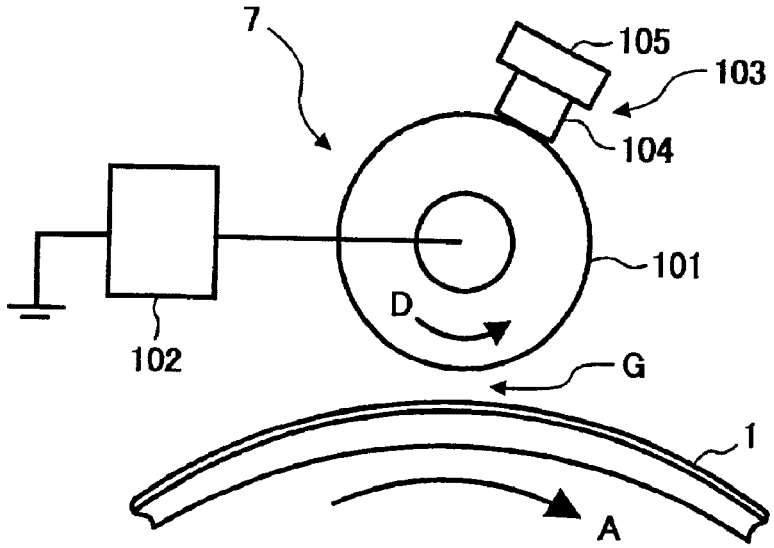
FIG. 21 is an enlarged view of a charging device of the image forming apparatus of FIG. 2.

As illustrated in FIG. 21, the charging member 101 is provided in a vicinity of the image bearer 1 without contacting the surface of the image bearer 1. The charging member 101 is opposite to the image bearer 1 such that a small gap G is formed between the surface of the charging member 101 and the surface of the image bearer 1. With the above-described arrangement of the charging member 101, even when all the transfer residual toner cannot be removed by the cleaning member, and an extremely small amount of toner passes through the cleaning member and moves to the charging member 101, the toner can be effectively prevented from adhering to the surface of the charging member 101. A part of the transfer residual toner passed through the cleaning member may be sometimes detached and scattered from the surface of the image bearer 1. However, because the charging member 101 is arranged apart from the surface of the image bearer 1, an adhesion force of the scattered toner to the charging member 101 is weak, and the scattered toner can be effectively prevented from adhering to the charging member 101.

As described above, in the image forming apparatus according to the embodiments of the present embodiment, a spherical dry toner is used. Further, in the image forming apparatus, the cleaning member that electrostatically attracts the transfer residual toner from the image bearer is used as the cleaning member that removes the transfer residual toner from the image bearer, and the charging member arranged in the vicinity of the image bearer without contacting the surface of the image bearer is used as the charging member that charges the surface of the image bearer. By use of such the cleaning member and the charging member, the transfer residual toner is efficiently removed from the surface of the image bearer, and the toner is effectively prevented from adhering to the charging member. Particularly, a large amount of toner is prevented from locally adhering to the charging member. With this construction, the surface of the image bearer may be uniformly charged over a long time, and a high quality image may be formed while taking advantage of the spherical dry toner. Further, the useful lifetime of the charging member may be increased.

In this embodiment, for example, a cylindrical charging roller is used as the charging member 101. The charging member 101 charges the surface of the image bearer 1 while rotating in a direction of an arrow C in FIG. 21. Alternatively, the charging member 101 may charge the surface of the image bearer 1 while stopping. Further, the charging members other than the charging roller, such as a charging brush or a charging blade may be also used. Even when any charging members are employed, the gap G between the charging member 101 and the surface of the image bearer 1 is preferably 10 $\mu$m to 150 $\mu$m.

When a contact type charging member contacting the surface of the image bearer is used instead of the charging member 101, the toner may easily adhere to the charging member. Further, there is a possibility that an abnormal image called a tailing of image occurs. Moreover, a wear amount of the image bearer increases, and the useful lifetime of the image bearer decreases. Furthermore, because the charging member contacting the surface of the image bearer rubs the toner and paper powder against the surface of the image bearer, the charging member is stained. By the use of the charging member 101, the disadvantages of the contact type charging member are typically overcome.

Moreover, when using a charging device including a charge wire, and a corona discharge unit whose distance from a surface of an image bearer is greater than 150 $\mu$m, a high voltage needs to be applied to the charge wire, and a large amount of ozone is possibly generated with the electric discharge. However, these disadvantages may be prevented by using the charging member 101.

When the above-described cleaning members are used, the toner on the surface of the image bearer 1 is effectively removed therefrom. However, a slight amount of toner passes through the cleaning member, and the toner is scattered from the image bearer 1. Therefore, it is difficult to completely prevent the scattered toner from adhering to the surface of the charging member 101. As the charging member 101 is stained by the toner with a lapse of time, the charging function of the charging member 101 is deteriorated.

In order to avoid the stain on the charging member 101, as illustrated in FIGS. 21 to 24, it is preferable that a cleaner that removes the toner adhering to the charging member 101 is provided.

In the example of the charging device 7 illustrated in FIG. 21, as a cleaner 103 for cleaning the charging member 101, an elastic cleaner is used. Specifically, at least a portion of the cleaner 103 which contacts the surface of the charging member 101 is made of an elastic material 104. The elastic material 104 is fixedly held by a holder 105. When the charging member 101 rotates in a direction of an arrow D, the elastic material 104 of the cleaner 103 slides on the surface of the charging member 101, and thereby the toner adhering to the surface of the charging member 101 is removed.

Figure 22:
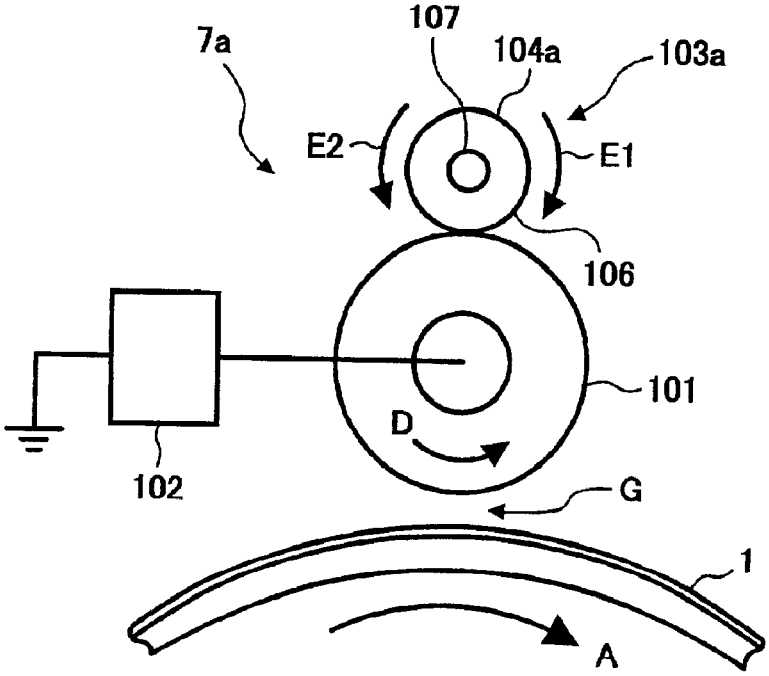
FIG. 22 is an enlarged view of another charging device including an elastic roller as a cleaner.

In another example of a charging device 7*a* illustrated in FIG. 22, as a cleaner 103*a* for cleaning the charging member 101, a rotatably supported elastic roller 106 is used. At least a portion of the elastic roller 106 which contacts the surface of the charging member 101 is made of an elastic material 104*a*. The elastic material 104*a* is fixed to an outer peripheral surface of a core metal 107 rotatably supported by a support member (not shown). At least during the cleaning of the charging member 101, the elastic roller 106 rotates in a direction of an arrow E1 or E2, and slides on the surface of the charging member 101, and thereby removing the toner adhering to the surface of the charging member 101. In this example, while the cleaner 103*a* is rotated, the peripheral surface of the cleaner 103*a* successively contacts the charging member 101 and removes the toner adhering to the surface of the charging member 101. Therefore, as compared to a cleaner which always contacts the charging member 101 with the same surface, such as the fixed type cleaner 103 illustrated in FIG. 21, the cleaning efficiency of the charging member 101 is enhanced, and the useful lifetime of the cleaner 103*a* can be extended.

The elastic material 104 of the cleaner 103 and the elastic material 104*a* of the cleaner 103*a* illustrated in FIGS. 21 and 22, respectively, may be formed from solid rubber, and the like. However, when the materials are soft foaming materials, the cleaning efficiency of the charging member 101 is enhanced, and the peripheral surface of the charging member 101 can be prevented from being damaged.

The above-described forming materials of the elastic materials 104 and 104*a* may have a connecting cell structure or a closed-cell structure. With the connecting cell structure, the cleaning ability of the cleaners 103 and 103*a* for the charging member 101 is particularly enhanced.

Figure 23:
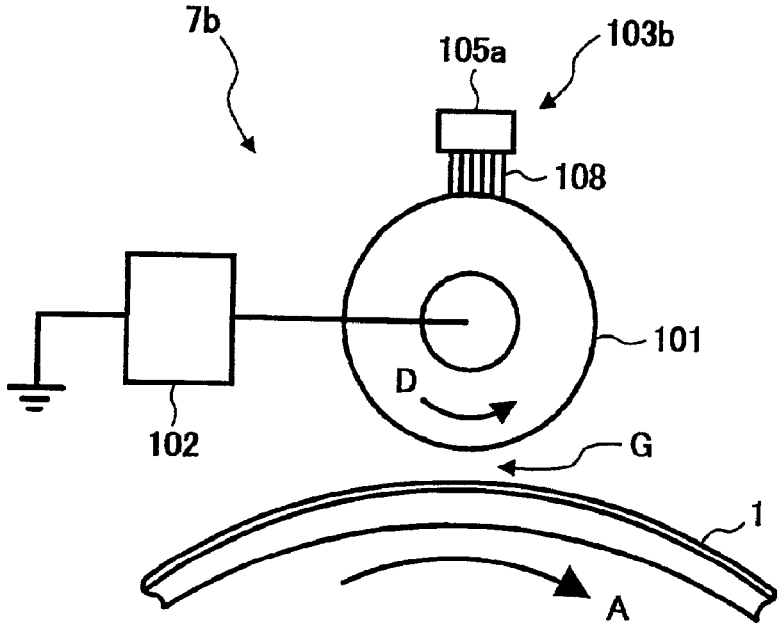
FIG. 23 is an enlarged view of another charging device including a cleaner having a brush.

In another example of a charging device 7*b* illustrated in FIG. 23, a cleaner 103*b* for cleaning the charging member 101 includes a brush 108 which contacts the charging member 101. A base end of the brush 108 is fixed to a fixedly provided holder 105*a*. When the charging member 101 rotates, the brush 108 slides on the surface of the charging member 101, and removes the toner adhering to the surface of the charging member 101. The cleaner 103*b* including the brush 108 can be manufactured at a cost lower than that of the cleaner 103*a* including the elastic roller 106 illustrated in FIG. 22.

Figure 24:
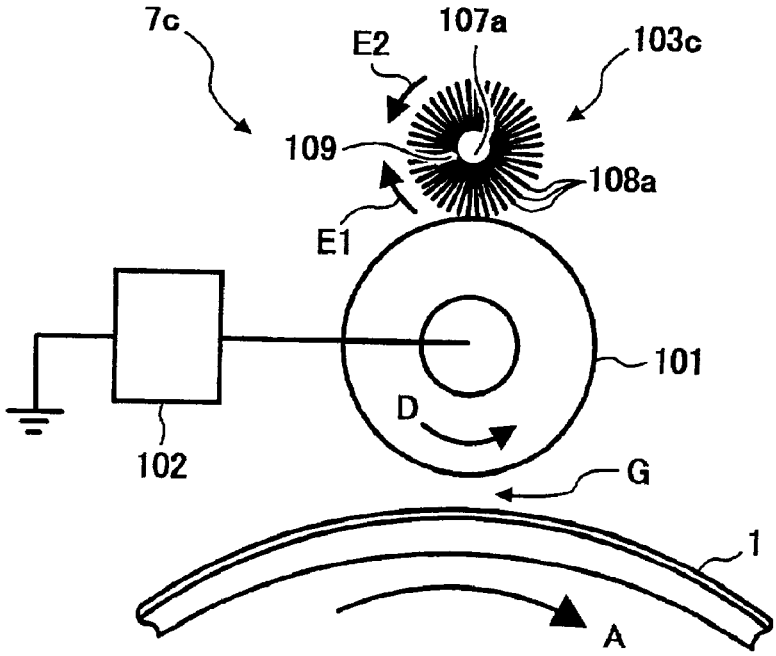
FIG. 24 is an enlarged view of another charging device including a brush roller as a cleaner.

In another example of a charging device 7*c* illustrated in FIG. 24, a cleaner 103*c* for cleaning the charging member 101 includes a rotatable brush roller 109 having a brush 108*a* which contacts the charging member 101. The base end of the brush 108*a* is fixed to a core metal 107*a* rotatably supported by a support member (not shown). At least during the cleaning of the charging member 101, the brush roller 109 rotates in a direction of an arrow E1 or E2, and removes the toner adhering to the surface of the charging member 101. When the brush roller 109 is used, the brush 108*a* successively contacts the peripheral surface of the charging member 101, and the useful lifetime of the brush roller 109 can be longer than that of the cleaner 103*b* including the brush 108 illustrated in FIG. 23.

The rotational direction of the cleaners 103*a* and 103*c* illustrated in FIGS. 22 and 24 may be appropriately set. Further, the cleaners 103*a* and 103*c* may be constructed to rotate by the rotation of the charging member 101. However, when the cleaners 103*a* and 103*c* are rotated by the rotation of the charging member 101, the slide friction force between the cleaners 103*a*/103*c* and the charging member 101 is weakened, and the cleaning function of the cleaners 103*a* and 103*c* for the charging member 101 is deteriorated.

Therefore, in the examples, it is preferable that the cleaners 103*a* and 103*c* are rotated so that each moving direction of the cleaners 103*a* and 103*c* illustrated by the arrow E1 in FIGS. 22 and 24 is the same as the moving direction of the charging member 101 illustrated by the arrow D in FIGS. 22 and 24 at a position where the cleaners 103*a* or 103*c* contacts the charging member 101. Further, each moving speed of the cleaners 103*a* and 103*c* is preferably different from the moving speed of the charging member 101 at the position where the cleaners 103*a* or 103*c* contacts the charging member 101.

It is also preferable that the cleaners 103*a* and 103*c* are rotated so that each moving direction of the cleaners 103*a* and 103*c* illustrated by the arrow E2 in FIGS. 22 and 24 is opposite to the moving direction of the charging member 101 illustrated by the arrow D in FIGS. 22 and 24 at the position where the cleaners 103*a* or 103*c* contacts the charging member 101.

When the cleaners 103*a* and 103*c* are driven to rotate in each direction by a driving device (not shown) as described above, the cleaners 103*a* and 103*c* are brought into slide contact with the charging member 101, and the cleaning ability of the cleaners 103*a* and 103*c* for the charging member 101 can be enhanced. However, when relative speeds of the cleaners 103*a* or 103*c* and the charging member 101 are too great, the deterioration of the cleaners 103*a* and 103*c* and charging member 101 is accelerated. Therefore, it is preferable to set the rotation speeds of the cleaners 103*a* and 103*c* and charging member 101 in consideration of the above-described relative speeds.

Further, the cleaners 103, 103*a*, 103*b*, and 103*c* illustrated in FIGS. 21 to 24 are configured to contact the charging member 101 while rocking in the axial direction of the charging member 101. With this configuration of the cleaners 103, 103*a*, 103*b*, and 103*c*, the toner adhering to the charging member 101 is dispersed in a longitudinal direction of the charging member 101, and can be removed. As a result, the occurrence of charging unevenness in the image bearer 1 due to the stain on the charging member 101 is prevented.

Figure 25:
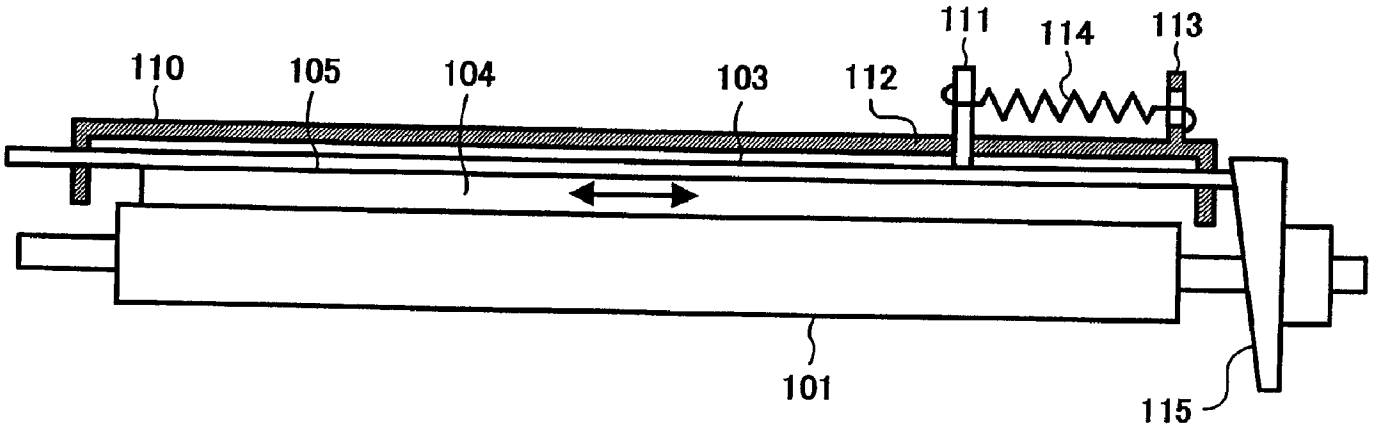
FIG. 25 is a partially sectional view of a driving device that allows the cleaner to rock.

FIG. 25 illustrates an example of a driving device that allows the cleaner 103 of FIG. 21 to rock as described above. Referring to FIG. 25, the elastic material 104 of the cleaner 103 contacts the charging member 101, and each end of the holder 105 in the longitudinal direction that supports the elastic material 104 is supported in a fixedly provided case 110 so that the holder 105 is slidable in the longitudinal direction thereof as indicated by a double-headed arrow in FIG. 25. Moreover, a guide protrusion 111 fixed to the holder 105 is slidably engaged in a guide hole 112 formed in the case 110, and the respective ends of a tension spring 114 are attached to the guide protrusion 111 and a protrusion 113 of the case 110. With this construction, the cleaner 103 is biased rightward in FIG. 25. Further, a cam 115 is fixed to a core shaft of the charging member 101, and a right end of the holder 105 is press-contacted against a cam surface of the cam 115. When the charging member 101 rotates, the cam 115 also rotates, thereby causing the holder 105 to reciprocate in the longitudinal direction of the charging member 101. As a result, the cleaner 103 rocks. The cleaner 103*b* illustrated in FIG. 23 can be rocked similarly as described above.

Figure 26:
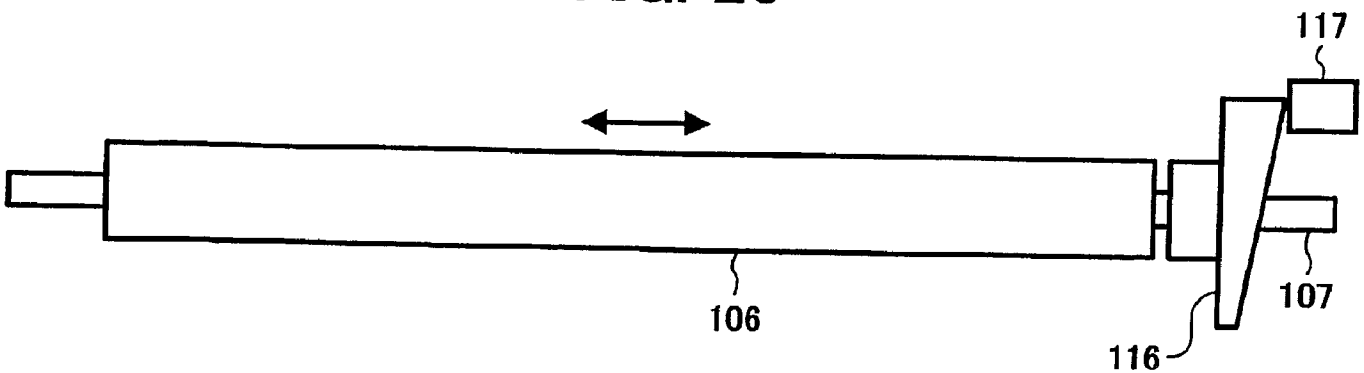
FIG. 26 is a partially sectional view of another driving device that allows the cleaner to rock.

FIG. 26 illustrates an example of a driving device that allows the cleaner 103*a* of FIG. 22 to rock. In the shown example, a cam 116 is fixed to a core metal 107 of the elastic roller 106 which contacts the charging member 101 (not shown in FIG. 26), and the cam 116 is press-contacted against a fixedly provided fixing member 117 by a spring (not shown). When the elastic roller 106 rotates, the cam 116 also rotates. Therefore, the elastic roller 106 rocks in the longitudinal direction thereof while contacting the charging member 101.

Similarly as in the cleaners 103, 103*a*, 103*b*, and 103*c*, it is preferable that the above-described cleaning members of the cleaning devices 11, 18*a*, 18*b*, 18*c*, 40 rock in the axial direction thereof. The driving device for allowing the cleaning members to rock in the above-described manner can be constructed similarly as the driving device illustrated in FIG. 26. Specifically, the cleaning member is disposed instead of the elastic roller 106 illustrated in FIG. 26, and the cleaning member is allowed to rock in the axial direction.

Cleaners other than the cleaners 103, 103*a*, 103*b*, and 103*c* illustrated in FIGS. 21 to 24 may be also used. For example, a cleaner formed from a non-woven fabric or a synthetic resin having a low hardness may be provided in contact with the charging member to remove the toner adhering to the surface of the charging member.

Moreover, while the charging voltage is not applied to the charging member 101, the direct current voltage having the polarity for electrostatically attracting the toner on the charging member 101 toward the cleaner, or the voltage in which the alternating current voltage is superimposed upon the direct current voltage is applied to the cleaner. In this construction, the cleaning ability of the cleaner for the charging member 101 can be enhanced.

Hereinafter is described an example in which the above-described cleaning device is applied to another image forming apparatus.

Figure 27:
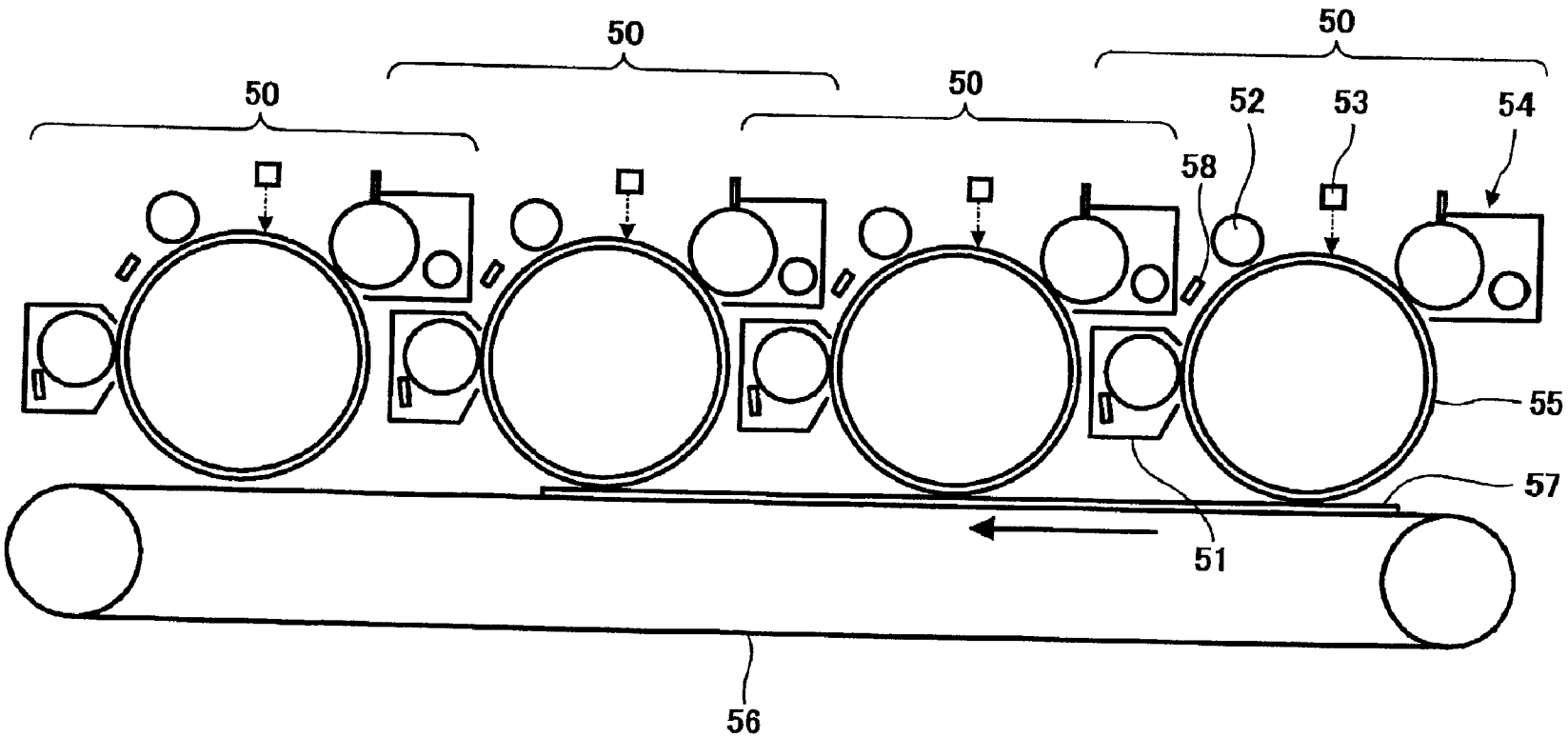
FIG. 27 is a schematic view of a main part of a color image forming apparatus to which the present invention is applied.

FIG. 27 illustrates a color image forming apparatus in which a cleaning device 51 including a roller-shaped cleaning member is used, and four image forming units 50 are disposed along a transfer belt 56 extending substantially horizontally.

The image forming unit 50 includes an image bearer 55, a charging device 52, an exposing device 53 serving as a latent image forming device, a developing device 54, a cleaning device 51, and a discharging device 58. Four image forming units 50 are disposed for respective colors of yellow, magenta, cyan, and black. A toner image formed and developed by each image forming unit 50 is transferred to a transfer material 57 by the transfer belt 56 to which a transfer voltage is applied.

Yellow, magenta, cyan, and black toner images are formed by the respective image forming units 50, transferred to the transfer material 57 with each color toner image superimposed each other, and fixed by a fixing device (not shown). The operation has been described in order of yellow, magenta, cyan, and black, but the order of colors is not limited to this, and the image forming units 50 for respective colors may be arranged in any order.

The transfer residual toner remaining on the image bearer 55 without being transferred to the transfer material 57 is removed by the cleaning device 51 including the roller-shaped cleaning member. In this color image forming apparatus, a spherical dry toner is used which contains at least modified polyester having an urea bond as a toner binder, and contains a wax finely dispersed in the spherical dry toner. The toner image produced by this spherical dry toner has a gloss of 5% to 30% even when the temperature of the fixing member varies within 50 degrees (e.g., from 100 degrees to 150 degrees).

If an image forming apparatus employs a cleaning device including a cleaning blade, the coefficient of friction of an image bearer is decreased and the adhesion force between the image bearer and the toner is reduced by the wax filming on the image bearer. Thereby, the toner on the image bearer is easily transferred to a transfer material before a nip part formed between the image bearer and the transfer material by electric discharge, thereby causing an image deterioration such as toner scattering.

When using the cleaning device 51 including the roller-shaped cleaning member in the color image forming apparatus, no wax filming occurs onto the image bearer 55, thus the above-described toner scattering does not occur. Therefore, a good quality image can be obtained in the color image forming apparatus of FIG. 27. All the above-described cleaning devices 11, 18*a*, 18*b*, 18*c*, 40 can be used in the image forming apparatus of FIG. 27.

With respect to a charging device of an image forming apparatus, when a charging member of the charging device is locally stained by the toner, and the charging unevenness occurs on the surface of an image bearer, density unevenness in a toner image on the image bearer becomes more conspicuous and image quality deterioration becomes more remarkable in the color toner image, rather than in a black toner image. Therefore, all the aforementioned constructions for suppressing the density unevenness of the toner image can particularly preferably be applied, when the color toner image is formed on the image bearer. The respective constructions of the charging devices 7, 7*a*, 7*b*, and 7*c* can be particularly advantageously used in the color image forming apparatus.

Figure 28:
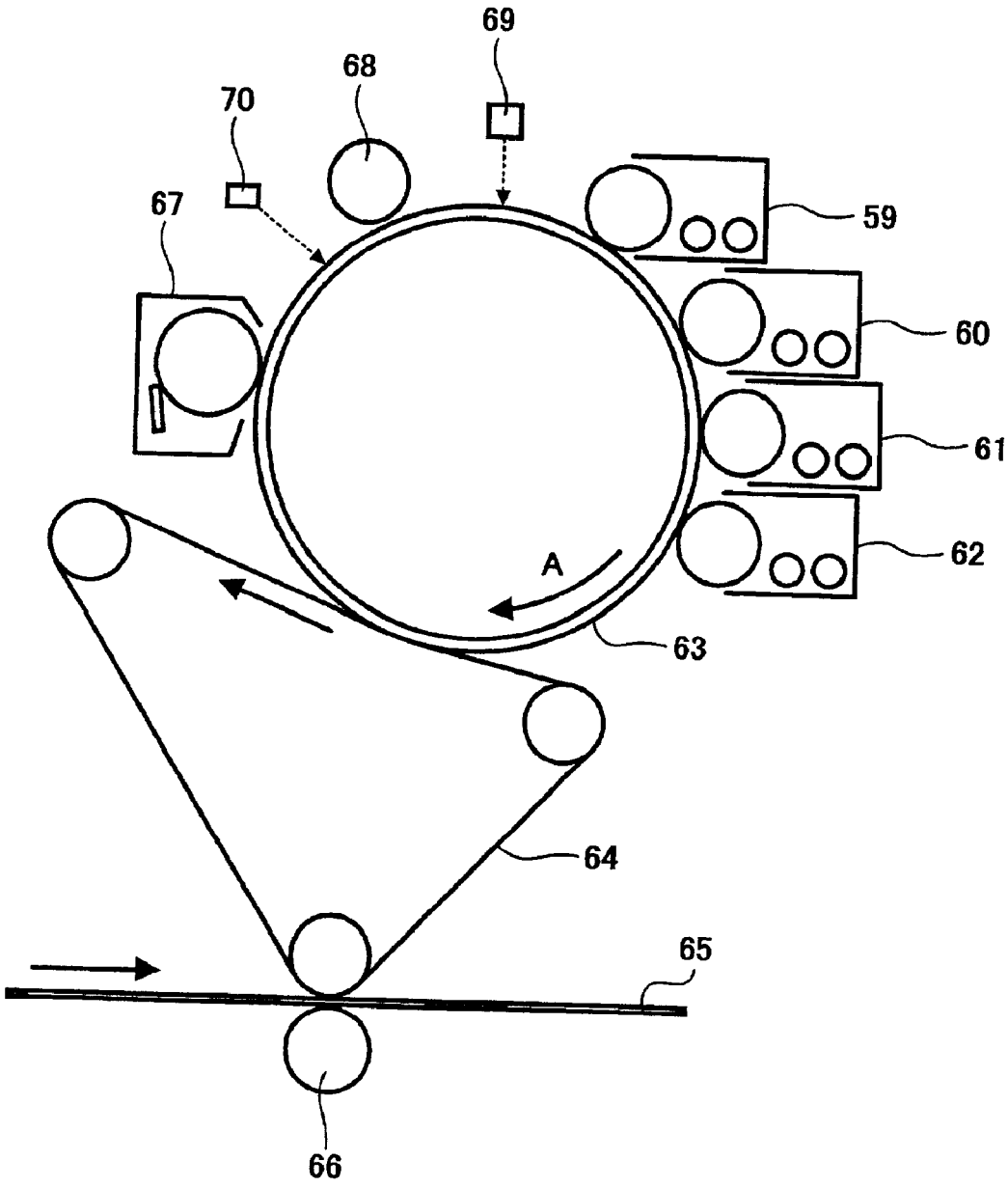
FIG. 28 is a schematic view of a main part of another color image forming apparatus to which the present invention is applied.
Figure 29:
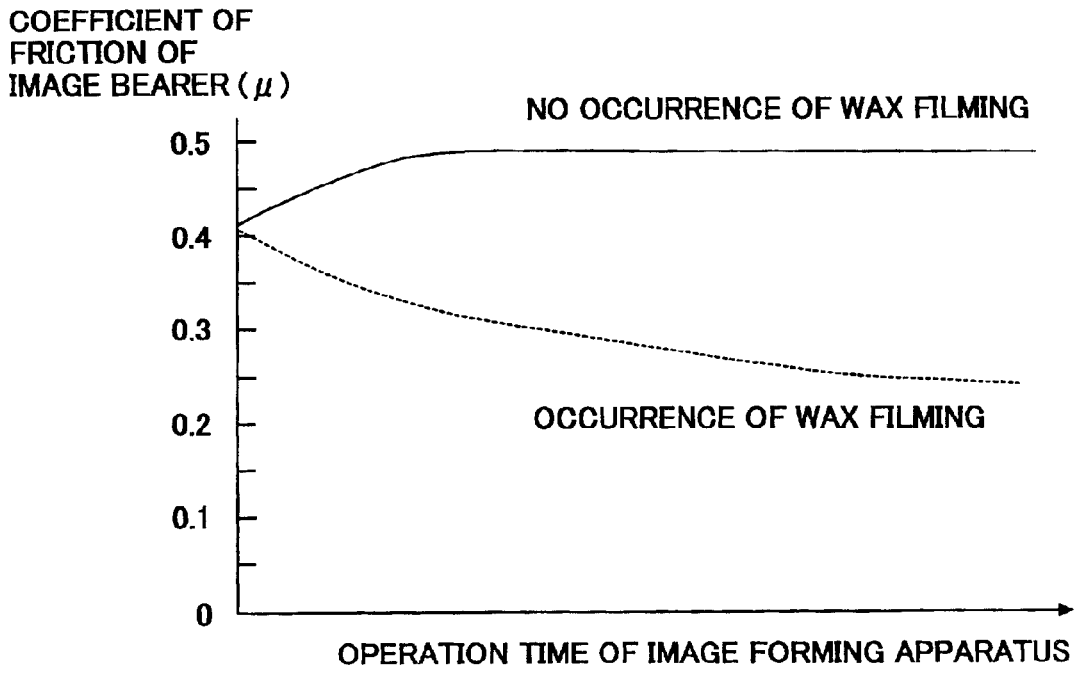
FIG. 29 is a graph showing a relationship between the coefficient of friction of an image bearer and an operation time of an image forming apparatus when a wax filming occurs and does not occur.

FIG. 28 illustrates another color image forming apparatus including a cleaning device 67 having a roller-shaped cleaning member. In the color image forming apparatus of FIG. 28, single-color toner images are formed on an image bearer 63 by a plurality of developing devices 59, 60, 61, and 62, and are superposed upon one another on an intermediate transfer member 64 to form a full color toner image. The full color toner image on the intermediate transfer member 64 is transferred onto a transfer material 65 by a transfer device 66 at one time.

The color image forming apparatus includes the image bearer 63, a charging device 68, an exposing device 69 serving as a latent image forming device, four developing devices 59, 60, 61 and 62, a cleaning device 67, and a discharging device 70. Four developing devices 59, 60, 61 and 62 are disposed for the respective colors of yellow, magenta, cyan, and black. The images are developed and transferred to the intermediate transfer member 64 in order of yellow, magenta, cyan, and black. The full color image of four colors is formed on the intermediate transfer member 64, and is transferred onto the transfer material 65 at one time. The full color image on the intermediate transfer member 64 is fixed by a fixing device (not shown). The order of forming images of respective colors and/or the arrangement of the developing devices 59, 60, 61, and 62 for respective colors are not limited to the ones described above and can be practiced otherwise.

The transfer residual toner remaining on the image bearer 63 without being transferred is removed by the cleaning device 67 including the roller-shaped cleaning member. In this color image forming apparatus, a spherical dry toner is used which contains at least modified polyester having an urea bond as a toner binder, and contains a wax finely dispersed in the spherical dry toner. The toner image produced by this spherical dry toner has a gloss of 5% to 30% even when the temperature of the fixing member varies within 50 degrees (e.g., from 100 degrees to 150 degrees).

If an image forming apparatus employs a cleaning device including a cleaning blade, the wax filming occurs on an image bearer, and the wax is transferred to an intermediate transfer member 64. As a result, each of the coefficient of friction of the image bearer and the intermediate transfer member is decreased, and the adhesion forces between the image bearer and the toner and between the intermediate transfer member and the toner are reduced. Thereby, an image deterioration such as toner scattering is caused by the electric discharge as described above.

The amount of scattered toner increases by the transfer (primary transfer) to the intermediate transfer member, and the transfer (secondary transfer) to the transfer material from the intermediate transfer member.

When using the cleaning device 67 including the roller-shaped cleaning member in the color image forming apparatus, no wax filming occurs on the image bearer 63, thus the above-described toner scattering does not occur. Therefore, a good quality image can be also obtained in the color image forming apparatus of FIG. 28. All the above-described cleaning devices 11, 18*a*, 18*b*, 18*c*, 40 can be also used in the image forming apparatus of FIG. 28.

Further, in this type of the color image forming apparatus of FIG. 28, a part of the toner image primarily transferred onto the intermediate transfer member is reversely transferred onto the surface of the image bearer in some cases. Therefore, in the conventional color image forming apparatus, when the color toner is used, the toner easily adheres to the charging member of the charging device. There is typically a high possibility that the charging member is stained by the toner at an early stage. When the respective constructions of the charging devices 7, 7*a*, 7*b*, and 7*c* are used in this type of the color image forming apparatus, the conventional disadvantages are removed, and a high quality image may be formed.

In the above-described cleaning devices and image forming apparatuses according to the embodiments of the present invention, the spherical dry toner which contains at least modified polyester having a urea bond as a toner binder, and contains a wax finely dispersed in the spherical dry toner is used as the toner for forming the toner image on the image bearer. As described above, the toner prepared by the polymerization method has a property similar to the property of the spherical dry toner, and a high quality image can be formed. However, when the toner prepared by the polymerization method is used in the conventional image forming apparatus, the disadvantages similar to those with the use of the spherical dry toner are possibly generated. Therefore, even when the toner prepared by the polymerization method is used instead of the spherical dry toner, the aforementioned respective constructions of the cleaning device and the image forming apparatus are used, and the useful lifetime of the roller-shaped cleaning member may be extended as compared to the blade-shaped cleaning member, without having the wax filming on the surface of the image bearer.

As described above, in the image forming apparatus including the cleaning device according to the embodiments of the present invention, an electric field is formed between the cleaning member and the image bearer by applying a voltage to the cleaning member so that the spherical toner adhered onto the image bearer is electrostatically attracted to the cleaning member. In such an image forming apparatus, the cleaning device removes residual toner on the image bearer while preventing the wax in the toner from bleeding out and thereby avoiding the occurrence of the wax filming. Further, the cleaning device removes residual toner on the image bearer without giving much mechanical stress against the toner and the image bearer. Therefore, the useful lifetime of the image bearer can be increased.

The present invention has been described with respect to the embodiments illustrated in figure. However, the present invention is not limited to the embodiments and may be practiced otherwise.

In the above embodiments, the photoreceptors 1, 55, and 63 are configured to be a photoconductor drum. However, the photoreceptors 1, 55, and 63 may be configured to be a belt.

As the charging device 7, a Scorotron charging device including an electrode wire and a grid electrode, disposed in a non-contacting relation to the image barer 1 may be used.

Further, the image forming apparatus may use a spherical toner including a polyester resin, a spherical toner including a urea bond, or a spherical toner including a wax.

Numerous additional modifications and variations of the present invention are possible in light of the above teachings. It is therefore to be understood that within the scope of the appended claims, the present invention may be practiced otherwise than as specifically described herein.

This document claims priority and contains subject matter related to Japanese Patent Application No. 2001-091696 filed in the Japanese Patent Office on Mar. 28, 2001, and Japanese Patent Application No. 2001-150087 filed in the Japanese Patent Office on May 18, 2001, and the entire contents of each of which are hereby incorporated herein by reference.

What is claimed is:

1. A cleaning device comprising:

a cleaning member configured to remove a spherical toner on an image bearer while rotating and contacting the image bearer which is rotating, a surface of said cleaning member having a greater coefficient of static friction than a surface of the image bearer, wherein an electric field is formed between the cleaning member and the image bearer by applying a voltage to the cleaning member so that the spherical toner adhered onto the image bearer is electrostatically attracted to the cleaning member.

2. The cleaning device according to claim 1, wherein the cleaning member is a cleaning roller in which at least a portion of the cleaning roller which contacts the image bearer is made of an elastic material.

3. The cleaning device according to claim 2, wherein a rotation speed of the cleaning roller is substantially equal to a rotation speed of the image bearer at a position where the cleaning roller contacts the image bearer.

4. The cleaning device according to claim 2, wherein a rotation speed of the cleaning roller is different from a rotation speed of the image bearer at a position where the cleaning roller contacts the image bearer.

5. The cleaning device according to claim 3, further comprising a toner scraping member configured to scrape the spherical toner off the cleaning roller, wherein the toner scraping member abuts against the cleaning roller.

6. The cleaning device according to claim 4, further comprising a toner scraping member configured to scrape the spherical toner off the cleaning roller, wherein the toner scraping member abuts against the cleaning roller.

7. The cleaning device according to claim 1, further comprising a polarity control device configured to change the polarity of the residual toner on the image bearer to a polarity opposite to that of the voltage applied to the cleaning member, wherein the polarity control device is provided at an upstream position of the cleaning member in a moving direction of the image bearer.

8. The cleaning device according to claim 1, wherein the cleaning member is rotated so that a moving direction of the cleaning member is the same as a moving direction of the surface of the image bearer at a position where the cleaning member contacts the image bearer.

9. The cleaning device according to claim 1, wherein the cleaning member is rotated so that a moving direction of the cleaning member is opposite to a moving direction of the surface of the image bearer at a position where the cleaning member contacts the image bearer.

10. The cleaning device according to claim 1, wherein the spherical toner is prepared by a polymerization method.

11. The cleaning device according to claim 1, wherein the spherical toner includes a polyester resin.

12. The cleaning device according to claim 1, wherein the spherical toner includes a urea bond.

13. The cleaning device according to claim 1, wherein the spherical toner includes a wax.

14. An image forming apparatus, comprising:

an image bearer configured to bear an electrostatic latent image while rotating;

a charging device configured to charge a surface of the image bearer;

a latent image forming device configured to form the electrostatic latent image on the image bearer;

a developing device configured to develop the electrostatic latent image on the image bearer with a spherical toner into a toner image;

a transfer device configured to transfer the toner image to a transfer material; and a cleaning device configured to remove the spherical toner remaining on the image bearer after the toner image is transferred to the transfer material by the transfer device, the cleaning device including a cleaning member configured to remove the spherical toner on the image bearer while rotating and contacting the image bearer, a surface of said cleaning member having a greater coefficient of static friction than the surface of the image bearer, wherein an electric field is formed between the cleaning member and the image bearer by applying a voltage to the cleaning member so that the spherical toner adhered onto the image bearer is electrostatically attracted to the cleaning member.

15. The image forming apparatus according to claim 14, wherein the charging device includes a charging member configured to charge the surface of the image bearer, and wherein the charging member is arranged adjacent to the image bearer in a non-contacting relation to the surface of the image bearer.

16. The image forming apparatus according to claim 14, wherein the cleaning member is a cleaning roller in which at least a portion of the cleaning roller which contacts the image bearer is made of an elastic material.

17. The image forming apparatus according to claim 14, wherein the cleaning member is rotated so that a moving direction of the cleaning member is a same as a moving direction of the image bearer, and a moving speed of the cleaning member is different from a moving speed of the image bearer at a position where the cleaning member contacts the image bearer.

18. The image forming apparatus according to claim 14, wherein the cleaning member is rotated so that a moving direction of the cleaning member is opposite to a moving direction of the image bearer at a position where the cleaning member contacts the image bearer.

19. The image forming apparatus according to claim 14, wherein the cleaning member is rotated so that a moving speed of the cleaning member is substantially equal to a moving speed of the image bearer at a position where the cleaning member contacts the image bearer.

20. The image forming apparatus according to claim 14, wherein the cleaning member rocks in an axial direction of the image bearer while contacting the surface of the image bearer.

21. The image forming apparatus according to claim 15, wherein the charging device further includes a cleaner configured to remove the spherical toner on the charging member while contacting the charging member.

22. The image forming apparatus according to claim 21, wherein the charging member is rotatable, and wherein at least a portion of the cleaner which contacts the charging member is made of an elastic material.

23. The image forming apparatus according to claim 21, wherein the charging member is rotatable, and wherein the cleaner is a rotatably supported elastic roller in which at least a portion of the elastic roller which contacts the charging member is made of an elastic material.

24. The image forming apparatus according to claim 22, wherein the elastic material includes a foaming material.

25. The image forming apparatus according to claim 23, wherein the elastic material includes a foaming material.

26. The image forming apparatus according to claim 24, wherein the foaming material has a connecting cell structure.

27. The image forming apparatus according to claim 25, wherein the foaming material has a connecting cell structure.

28. The image forming apparatus according to claim 21, wherein the charging member is rotatable, and wherein the cleaner includes a brush that contacts the charging member.

29. The image forming apparatus according to claim 21, wherein the charging member is rotatable, and wherein the cleaner includes a brush roller that rotates and contacts the charging member.

30. The image forming apparatus according to claim 21, wherein the cleaner is rotated so that a moving direction of the cleaner is a same as a moving direction of the charging member, and a moving speed of the cleaner is different from a moving speed of the charging member at a position where the cleaner contacts the charging member.

31. The image forming apparatus according to claim 21, wherein the cleaner is rotated so that a moving direction of the cleaner is opposite to a moving direction of the charging member at a position where the cleaner contacts the charging member.

32. The image forming apparatus according to claim 21, wherein the cleaner rocks in an axial direction of the charging member while contacting the charging member.

33. The image forming apparatus according to claim 14, further comprising a polarity control device configured to change the polarity of the residual toner on the image bearer to a polarity opposite to that of the voltage applied to the cleaning member, wherein the polarity control device is provided downstream of a transfer position where the toner image is transferred to the transfer material by the transfer device and upstream of a cleaning position where the cleaning member removes the spherical toner on the image bearer, in a moving direction of the image bearer.

34. The image forming apparatus according to claim 14, wherein the electrostatic latent image on the image bearer is developed with a color spherical toner into a color toner image.

35. The image forming apparatus according to claim 34, further comprising a plurality of image forming units, each of the image forming units integrally including the image bearer, the charging device, the latent image forming device, the developing device, and the cleaning device.

36. The image forming apparatus according to claim 35, wherein the image forming apparatus includes at least four image forming units.

37. The image forming apparatus according to claim 34, further comprising an intermediate transfer member configured to have the color toner image transferred thereto from the image bearer, wherein the color toner image transferred to the intermediate transfer member is further transferred to the transfer material.

38. The image forming apparatus according to claim 14, wherein the spherical toner is prepared by a polymerization method.

39. The image forming apparatus according to claim 14, wherein the spherical toner includes a polyester resin.

40. The image forming apparatus according to claim 14, wherein the spherical toner includes a urea bond.

41. The image forming apparatus according to claim 14, wherein the spherical toner includes a wax.

42. A cleaning device comprising:

means for removing a spherical toner on an image bearer while rotating and contacting the image bearer which is rotating, said means for removing having a greater coefficient of static friction than a surface of the image bearer, wherein an electric field is formed between the means for removing and the image bearer by applying a voltage to the means for removing so that the spherical toner adhered onto the image bearer is electrostatically attracted to the means for removing.

43. The cleaning device according to claim 42, further comprising means for changing the polarity of the residual toner on the image bearer to a polarity opposite to that of the voltage applied to a cleaning member, wherein the means for changing is provided at an upstream position of the means for removing in a moving direction of the image bearer.

44. An image forming apparatus, comprising:

means for bearing an electrostatic latent image while rotating;

means for charging a surface of the means for bearing;

means for forming the electrostatic latent image on the means for bearing;

means for developing the electrostatic latent image on the means for bearing with a spherical toner into a toner image;

means for transferring the toner image to a transfer material; and means for removing the spherical toner remaining on the means for bearing after the toner image is transferred to the transfer material by the means for transferring, the means for removing including a cleaning member that removes the spherical toner on the means for bearing while rotating and contacting the means for bearing, said means for removing having a greater coefficient of static friction than the surface of the image bearer, wherein an electric field is formed between the cleaning member and the means for bearing by applying a voltage to the cleaning member so that the spherical toner adhered onto the means for bearing is electrostatically attracted to the cleaning member.

45. The image forming apparatus according to claim 44, further comprising means for changing the polarity of the residual toner on the means for bearing to a polarity opposite to that of the voltage applied to the cleaning member, wherein the means for changing is provided downstream of a transfer position where the toner image is transferred to the transfer material by the means for transferring and upstream of a cleaning position where the cleaning member removes the spherical toner on the means for bearing, in a moving direction of the means for bearing.

46. A cleaning device comprising:

a cleaning member comprising a brush roller including bristles planted so that positions of the bristles are shifted every row configured to remove a spherical toner on an image bearer while rotating and contacting the image bearer which is rotating, wherein an electric field is formed between the cleaning member and the image bearer by applying a voltage to the cleaning member so that the spherical toner adhered onto the image bearer is electrostatically attracted to the cleaning member, and a following condition is satisfied:

$$d \geqq P/n$$

where "d" is a diameter of the bristle of the brush roller, "P" is a planting pitch in an axial direction of the brush roller, and "n" is a number of rows having the bristles in the same positions in a rotational direction of the brush roller.

47. A cleaning device comprising:

a cleaning member comprising a cleaning brush that rubs against an image bearer and a cleaning roller that abuts the image bearer at a downstream position of the cleaning brush in a moving direction of the image bearer configured to remove a spherical toner on the image bearer while rotating and contacting the image bearer which is rotating, wherein a rotational direction of the cleaning roller is set to the same direction with respect to the moving direction of the image bearer at a position where the cleaning roller contacts the image bearer, and an electric field is formed between the cleaning member and the image bearer by applying a voltage to the cleaning member so that the spherical toner adhered onto the image bearer is electrostatically attracted to the cleaning member.

48. An image forming apparatus, comprising:

an image bearer configured to bear an electrostatic latent image while rotating;

a charging device configured to charge a surface of the image bearer;

a latent image forming device configured to form the electrostatic latent image on the image bearer;

a developing device configured to develop the electrostatic latent image on the image bearer with a spherical toner into a toner image;

a transfer device configured to transfer the toner image to a transfer material; and a cleaning device configured to remove the spherical toner remaining on the image bearer after the toner image is transferred to the transfer material by the transfer device, the cleaning device including a cleaning member comprising a brush roller including bristles planted so that positions of the bristles are shifted every row configured to remove the spherical toner on the image bearer while rotating and contacting the image bearer, wherein an electric field is formed between the cleaning member and the image bearer by applying a voltage to the cleaning member so that the spherical toner adhered onto the image bearer is electrostatically attracted to the cleaning member, and a following condition is satisfied:

$$d \geqq P/n$$

where "d" is a diameter of the bristle of the brush roller, "P" is a planting pitch in an axial direction of the brush roller, and "n" is a number of rows having the bristles in the same positions in a rotational direction of the brush roller.

49. The cleaning device according to claim 46, wherein the cleaning member includes two brush rollers, a bias voltage of different polarity being applied to each brush roller.

50. The cleaning device according to claim 46, wherein the bristles include main bristles and sub bristles.

51. The cleaning device according to claim 47, wherein the cleaning brush is arranged so that the cleaning brush rubs against the cleaning roller.

52. The cleaning device according to claim 47, wherein a rotational direction of the cleaning brush is set to a counter direction with respect to the moving direction of the image bearer at a position where the cleaning brush rubs against the image bearer.

53. The cleaning device according to claim 47, wherein a bias voltage of different polarity is applied to each of the cleaning brush and the cleaning roller.

54. The cleaning device according to claim 51, wherein a rotational direction of the cleaning brush is set to the same direction with respect to a rotational direction of the cleaning roller at a position where the cleaning brush rubs against the cleaning roller, and wherein a rubbing speed of the cleaning brush against the cleaning roller is set to 10% or less of a peripheral speed of the cleaning roller.

55. The cleaning device according to claim 47, wherein a peripheral speed difference between the cleaning roller and the image bearer is set to 10% or less of a peripheral speed of the image bearer at a position where the cleaning roller abuts the image bearer.

* * * * *